US012385332B1

(12) United States Patent
Burns et al.

(10) Patent No.: US 12,385,332 B1
(45) Date of Patent: Aug. 12, 2025

(54) ROTATING GIN POLE

(71) Applicant: SWIVEL RENTAL & SUPPLY L.L.C., Lafayette, LA (US)

(72) Inventors: Douglas C. Burns, Youngsville, LA (US); Douglas A. Burns, Lafayette, LA (US)

(73) Assignee: SWIVEL RENTAL & SUPPLY L.L.C., Lafayette, LA (US)

( * ) Notice: Subject to any disclaimer, the term of this patent is extended or adjusted under 35 U.S.C. 154(b) by 0 days.

(21) Appl. No.: 18/332,053

(22) Filed: Jun. 9, 2023

Related U.S. Application Data

(60) Provisional application No. 63/380,038, filed on Oct. 18, 2022, provisional application No. 63/367,179, filed on Jun. 28, 2022.

(51) Int. Cl.
*E21B 19/22* (2006.01)
*E21B 15/00* (2006.01)
*E21B 17/02* (2006.01)

(52) U.S. Cl.
CPC ..... *E21B 19/22* (2013.01); *E21B 15/00* (2013.01); *E21B 17/023* (2013.01)

(58) Field of Classification Search
CPC ..... E21B 19/00; E21B 19/20; E21B 19/22; E21B 19/087; E21B 19/08
See application file for complete search history.

(56) References Cited

U.S. PATENT DOCUMENTS

| | | | | |
|---|---|---|---|---|
| 1,632,935 | A | 6/1927 | Turner et al. | |
| 4,703,811 | A * | 11/1987 | Lam | E02D 7/16 173/195 |
| 6,715,569 | B1 * | 4/2004 | Rogers | B66C 23/16 175/85 |
| 7,789,155 | B2 | 9/2010 | Moncus et al. | |
| 8,069,634 | B2 | 12/2011 | Livingston et al. | |
| 8,807,230 | B2 | 8/2014 | Sonnier | |
| 9,862,578 | B2 | 1/2018 | Jones | |
| 10,464,788 | B1 | 11/2019 | Bonifas | |
| 10,815,735 | B1 * | 10/2020 | Burns | E21B 15/003 |
| 11,142,439 | B2 | 10/2021 | White et al. | |
| 2007/0163186 | A1 | 7/2007 | Baugh et al. | |
| 2013/0291475 | A1 * | 11/2013 | Ruttley | E21B 7/023 52/650.3 |

(Continued)

FOREIGN PATENT DOCUMENTS

| | | |
|---|---|---|
| CA | 2646014 | 7/2012 |
| WO | WO2014127058 | 8/2014 |
| WO | WO2016118714 | 7/2016 |

OTHER PUBLICATIONS

Underbalance well completion—a modern approach for mature gas fields; Argentina Tataru and Nicolae Bogdan Simescu; Matec Web of Conferences 121, 09009; MSE 2017; pp. 1-7.

(Continued)

*Primary Examiner* — David Carroll
(74) *Attorney, Agent, or Firm* — Garvey, Smith & Nehrbass, Patent Attorneys, L.L.C.; Seth M. Nehrbass; Fabian M. Nehrbass

(57) ABSTRACT

The present invention includes a gin pole which can rotate and includes a traveling boom. The gin pole of the present invention can pick up and lay down joints of drill pipe, tubing and casing on plug and abandonment operations, while being independent of the crane.

8 Claims, 40 Drawing Sheets

(56) References Cited

U.S. PATENT DOCUMENTS

| | | | |
|---|---|---|---|
| 2014/0224499 | A1 | 8/2014 | Sanders et al. |
| 2017/0211340 | A1 | 7/2017 | Alford |
| 2019/0112880 | A1 | 4/2019 | Folwark |
| 2021/0140260 | A1 | 5/2021 | Sredensek |
| 2022/0186574 | A1 | 6/2022 | Quero |
| 2022/0315393 | A1 | 10/2022 | Bonifas |

OTHER PUBLICATIONS

Spartacus Jr. 12' Gin Pole—Spartacus Gin Pole (https://spartacusginpolellc.com/product/spartacus-jr-gin-pole), 3 pages.
Spartacus 15' Gin Pole With Bearing for 360 degree rotation of the rooster head (https:/spartacusgiinpolellc.com/product/spartacus-15-gin-pole), 2 pages.
Snubbing Unit—Jereh Yantai Jereh Petroleum Equipment and Technology (https://www.jereh-pe.com/en/products/drilling-and-workover-equipment), 2 pages.
Landa Mobile Systems—LMS PT 12 HD Gin Pole—Landa Mobile Systems LLC (https:landamobilesystems.com/gin-poles/triangular/lms-pt-12-hd-gin-pole), 7 pages.
How Snubbing Units Work—Rigzone (https://www.rigzone.com/training), 6 pages.
GT-Rig—New Design Features Allow for Faster Rig Up, Improved Safety; Snubbertech Oilfield Manufacturing, Ver. 07/16, 10 pages.
Snubbing (Chapter 16); pp. 1-50.
Snubbertech Oilfield Manufacturing, Brochure, 285K (TM), Ver. 10/16, 8 pages.

* cited by examiner

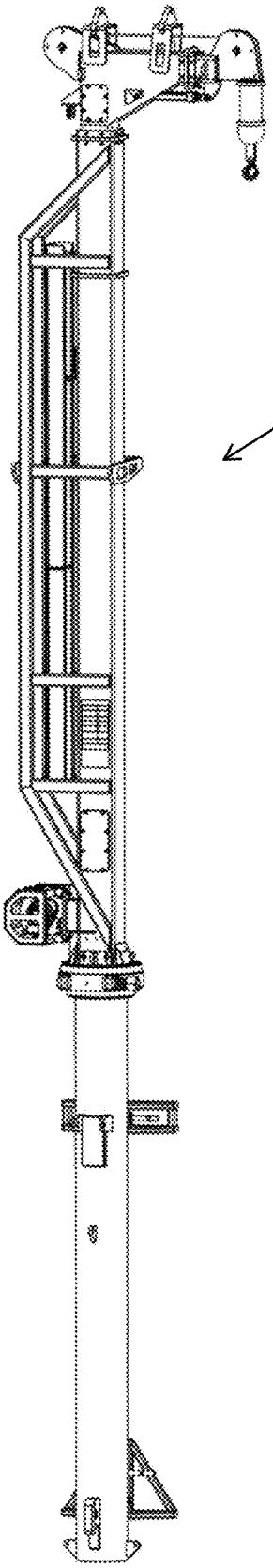
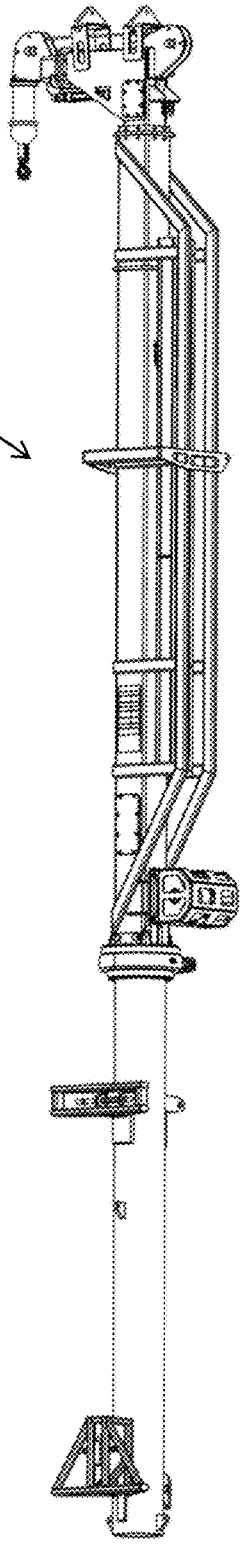
FIG. 6
FIG. 7

ROTATING GIN POLE

CROSS-REFERENCE TO RELATED APPLICATIONS

This application claims priority to U.S. Provisional Patent Application No. 63/380,038, filed Oct. 18, 2022 and U.S. Provisional Patent Application No. 63/367,179, filed 28 Jun. 2022, each which is hereby incorporated by reference.

STATEMENT REGARDING FEDERALLY SPONSORED RESEARCH OR DEVELOPMENT

Not applicable

BACKGROUND OF THE INVENTION

1 Field of the Invention

The present invention relates to oil field equipment. More specifically, the invention relates to gin poles.

2. General Background of the Invention

The present invention has the capability to pick up and lay down joints of drill pipe, tubing and casing on plug and abandonment (P&A) operations, both on land and offshore, while being independent of the crane. The present invention will speed up job times and save customers on overall job cost. The present invention is also able to perform workover/recompletions on existing oil and gas wells on both land and offshore. The present invention can keep projects running during high wind speeds that typically shut down the offshore cranes. Without the use of a crane, most projects have to suspend operations. One of the first embodiments of the present invention has the ability to work in wind speeds up to 50 mph. As use of cranes is typically shut down when the wind speeds reach 35 mph or more, the present invention allows for work to continue when cranes would no longer be available.

The present invention is a more effective solution than alternatives, such as the use of plug and abandonment pulling units, cranes, snubbing units, and oil rigs. Plug and abandonment pulling units are typically equipped with a structure like that of a rig that is used to pull and lay out casing and tubulars. Oil rigs will use a traveling block and a derrick to pick up and lay down pipe. Snubbing units normally use stationary gin poles and cranes to move the pipe about.

The following potentially relevant patent documents are incorporated herein by reference:

TABLE 1

| Document Number | Inventor(s) | Date |
|---|---|---|
| U.S. Pat. No. 1,632,935 | Turner et al. | Jun. 21, 1927 |
| U.S. Pat. No. 7,789,155 | Moncus et al. | Sep. 7, 2010 |
| U.S. Pat. No. 8,069,634 | Livingston et al. | Dec. 6, 2011 |
| U.S. Pat. No. 8,807,230 | Sonnier | Aug. 19, 2014 |
| U.S. Pat. No. 9,862,578 | Jones | Jan. 9, 2018 |
| U.S. Pat. No. 10,464,788 | Bonifas | Nov. 5, 2019 |
| U.S. Pat. No. 11,142,439 | White et al. | Oct. 12, 2021 |
| US 2007/0163186 | Baugh et al. | Jul. 19, 2007 |
| US 2013/0291475 | Ruttley et al. | Nov. 7, 2013 |
| US 2014/0224499 | Sanders et al. | Aug. 14, 2014 |
| US 2017/0211340 A1 | Alford | Jul. 27, 2017 |
| US 2019/0112880 A1 | Folwark | Apr. 18, 2019 |
| US 2021/0140260 A1 | Sredensek | May 13, 2021 |

TABLE 1-continued

| Document Number | Inventor(s) | Date |
|---|---|---|
| US 2022/0186574 A1 | Quero | Jun. 16, 2022 |
| US 2022/0315393 A1 | Bonifas | Oct. 6, 2022 |
| WO 2014/127058 | Sanders et al. | Aug. 8, 2021 |
| WO 2016/118714 | Segura | Jul. 28, 2016 |

BRIEF SUMMARY OF THE INVENTION

The present invention, a rotating gin pole, is a simpler and more effective apparatus than the aforementioned alternatives. The present invention includes a bearing that allows the pole to rotate. In one or more embodiments, the bearing allows the pole to rotate up to 180 degrees. In one or more embodiments, the bearing allows rotation of 360 degrees. Due to this rotation, the present invention is able to lay down/pick up pipe in different areas on a platform. Traditional gin poles are not capable of this. The traditional gin pole travels up and down and is not mounted on a bearing as in the present invention. The present invention, due to the rotating capability, has a working radius. In one or more embodiments, (for example, see a first prototype) the present invention features a 57½" working radius, though the present invention is not so limited. Other working radiuses are possible without departing from the spirit of the invention. As noted, traditional gin poles are stationary and do not have a working radius as in the present invention. The present invention can also have a cylinder that scopes the boom/hook out which allows the boom to be better aligned with the wellbore. In a first prototype, the cylinder can scope out the boom/hook approximately 12", though the present invention is not limited to such a distance. Preferably, the present invention will also be free of guy-wires, thus allowing one to work in tight areas with limited working space that might otherwise not be available. Preferably, the gin pole of the present invention has a stroke that will be telescoped out. In a first embodiment, the stroke is approximately a 17' stroke that will be telescoped out using a cylinder and without any locking pins. The present invention preferably features a support base which gives the option to rig up on a wellhead or on beams without swapping out the gin pole or the support base. The base can come with both blowout prevent (BOP) baseplate connections and drill beam connections. Increasing the connections allows for less rig up and rig downs and decreases equipment mobilization cost.

In one or more embodiments of the present invention, the gin pole can have a slewing bearing. The slewing bearing can allow approximately a 57½" working radius. Additionally, the gin pole of the present invention can have a traveling boom, such as a 12" traveling boom. Although a stationary boom could be used, a traveling boom helps with getting the hook centered over the wellbore. A stationary boom could still offer similar results but would lack the convenience and time savings offered by a traveling boom. An inner mast telescoping assembly can provide extension without lock pins. In a first embodiment, the inner mast telescoping assembly can extend approximately 17' by a cylinder without using lock pins. When rigged up on a workbasket, the pole of the present invention does not need guy-wires. In the present invention, the hydraulic components can be powered by a hydraulic power unit.

In one or more alternative embodiments, the gin pole of the present invention might lack the rotational capability. Such a stationary pole could travel up and down but would not have the ability to rotate and thus would not allow a wide working radius as in those preferred embodiments incorporating a bearing. The cylinder could also use locking pins to lock the pole in place once extended. The embodiment shown in FIG. 1 has a BOP baseplate and drill beam connection. In FIG. 1, the BOP baseplate and drill beam connection are approximately 180 degrees apart. An alternative to including both connections would be to build two separate support systems. However, such a design may require additional rig up and rig downs for the customer.

In one or more preferred embodiments of the present invention, the gin pole has a 17' telescopic outward stroke that functions without locking pins, a bearing which allows a full 180-degree rotation and a 57½" working radius, and a traveling boom (for example, a 12" traveling boom) to help better align with the wellbore (which allows for an easier and faster rig up). Moreover, the gin pole can also be rigged up without the use of guy-wires, unlike traditional gin poles. Moreover, the support base can be different than those of traditional gin poles. In one or more preferred embodiments of the present invention, the support base can work on BOP bases and drill beam bases, saving the customer on rig up time. The gin pole of the present invention could also mount to a work platform.

In one or more embodiments, the apparatus of the present invention can attach to a workbasket, directly to a set of beams, or to a BOP base. In one or more embodiments, the present invention can attach to utilizing pins.

In one or more embodiments, the apparatus of the present invention comprises a hydraulic cylinder. The hydraulic cylinder, when extended, allows the pole to lean. A travelling boom allows for better centering over a wellbore.

In one or more embodiments, the pole can rotate up to 360 degrees. Although complete rotation is possible, any hoses which may be utilized with the invention may get wrapped around the apparatus if the apparatus is rotated to the full extent. Thus, in some embodiments it may be preferable to utilize a stop to prevent the hoses from wrapping around the apparatus.

In one or more embodiments, the apparatus of the present invention can further comprise a compensator.

Traditionally, when there are high winds (for example, winds above 35 miles per hour), operations utilizing a crane on the offshore platform must be shut down. The present invention allows for the operations to continue during such times of high wind. The present invention can pull and lay down casing/tubing/drill pipe. Not only can the present invention be used during times of high wind, but the present invention can potentially eliminate the need for an additional platform crane altogether.

BRIEF DESCRIPTION OF THE SEVERAL VIEW OF THE DRAWINGS

For a further understanding of the nature, objects, and advantages of the present invention, reference should be had to the following detailed description, read in conjunction with the following drawings, wherein like reference numerals denote the like elements and wherein:

FIG. 6 is a side perspective view of a first embodiment of the apparatus of the present invention;

FIG. 7 is a side perspective view of a first embodiment of the apparatus of the present invention;

DETAILED DESCRIPTION OF THE INVENTION

Figure 1:
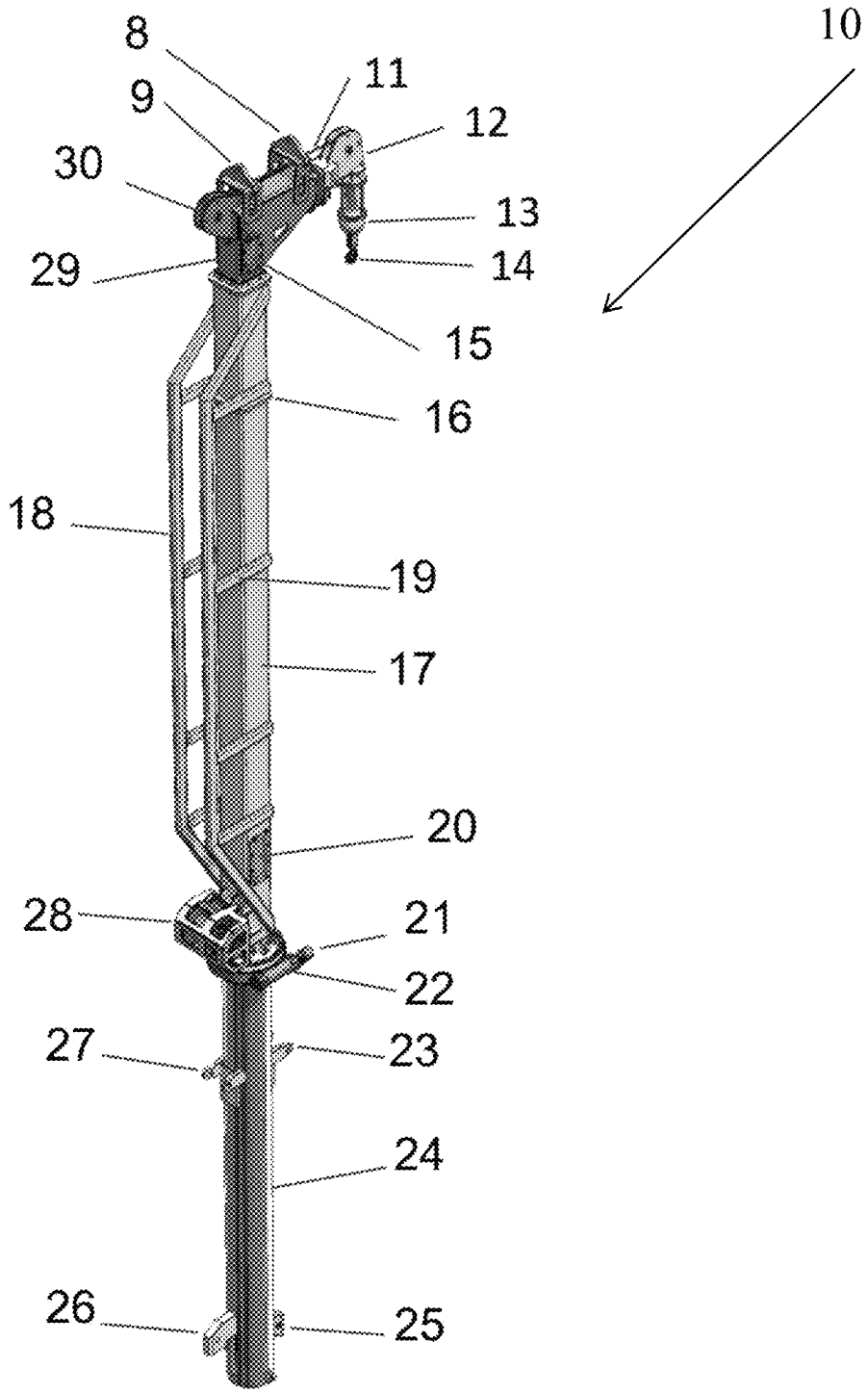
FIG. 1 is a side perspective view of a first embodiment of the apparatus of the present invention.
Figure 2:
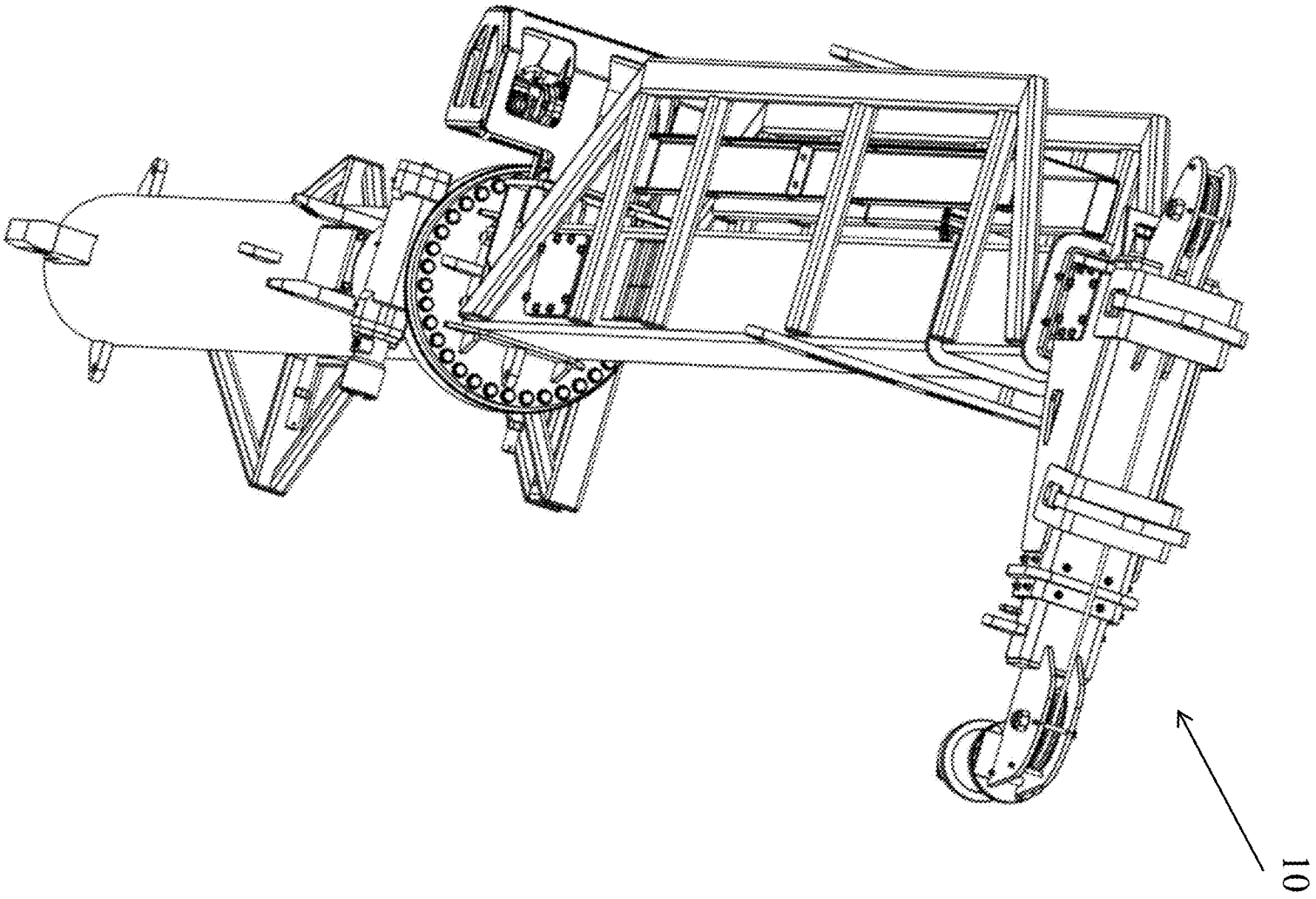
FIG. 2 is a top perspective view of a first embodiment of the apparatus of the present invention.
Figure 3:
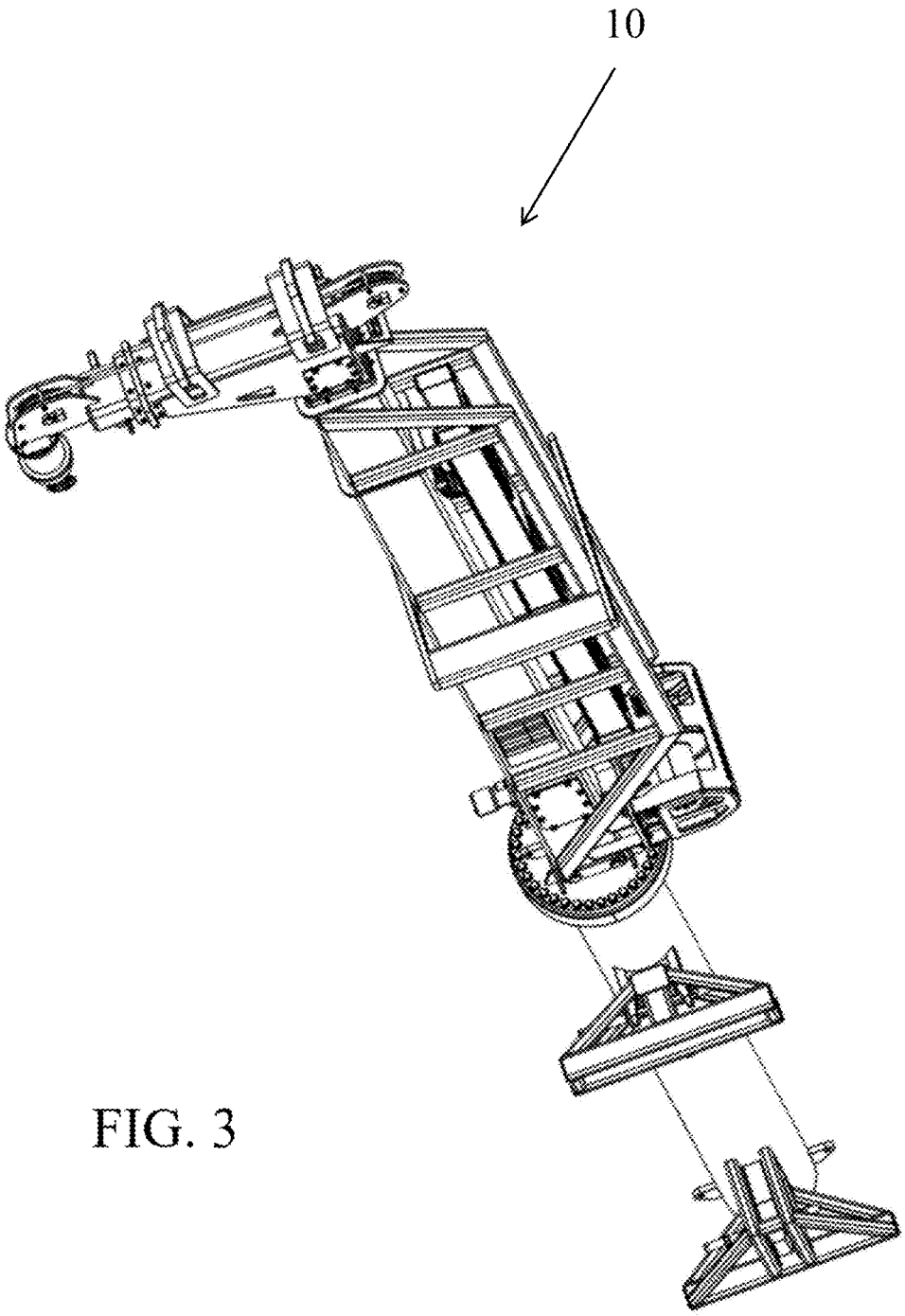
FIG. 3 is a top perspective view of a first embodiment of the apparatus of the present invention.
Figure 4:
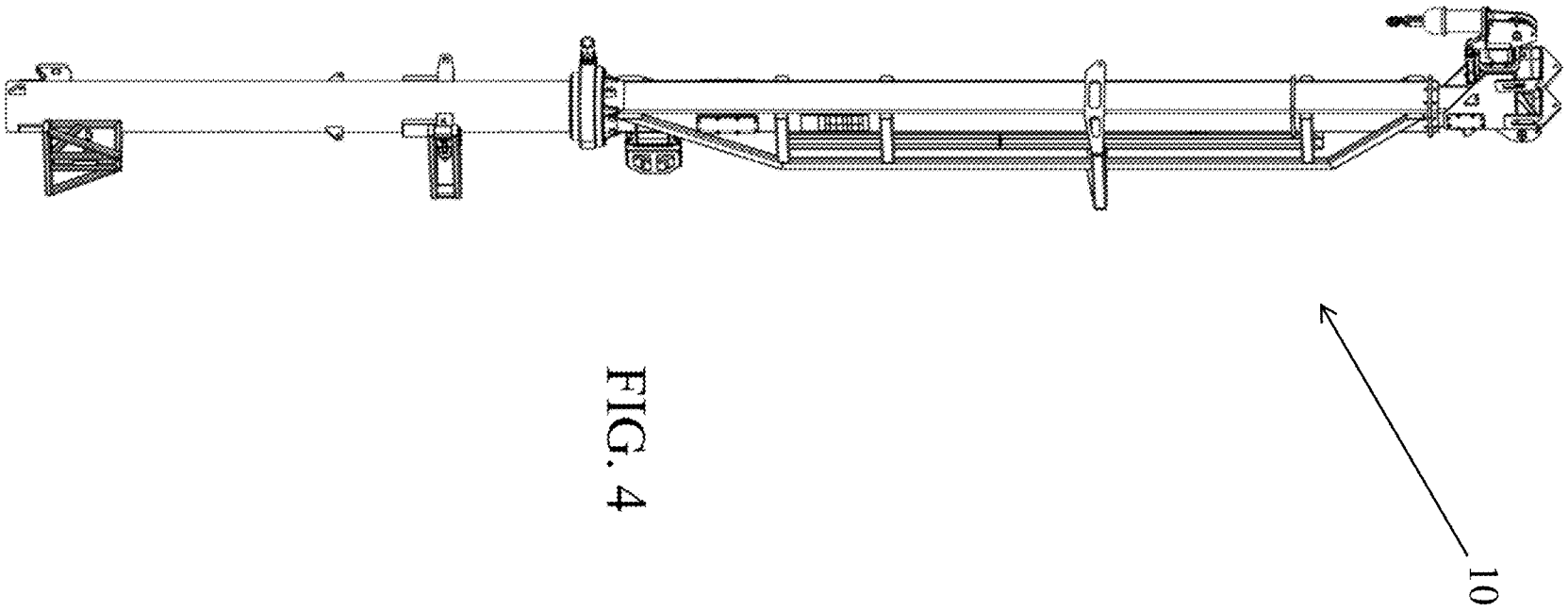
FIG. 4 is a side perspective view of a first embodiment of the apparatus of the present invention.
Figure 5:
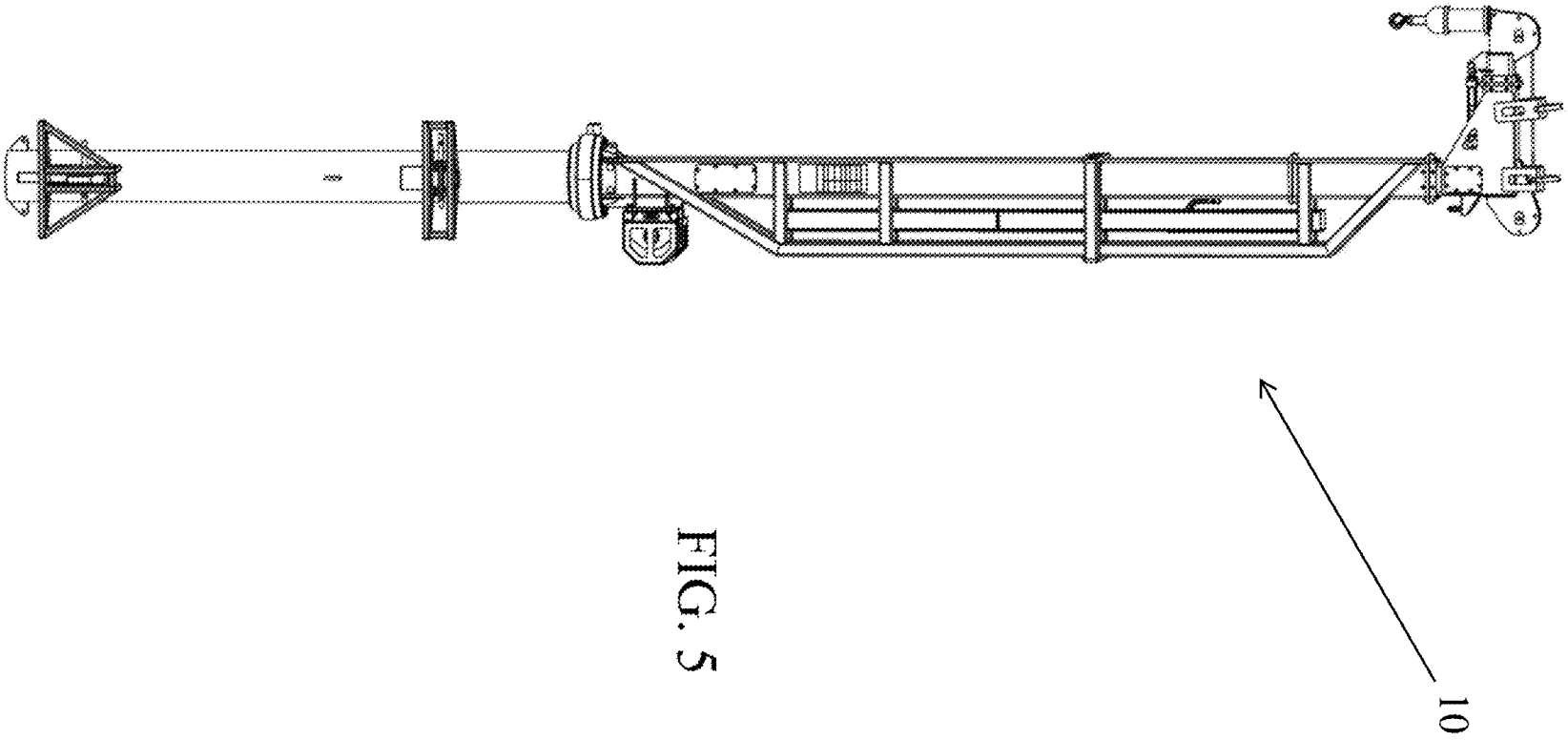
FIG. 5 is a side perspective view of a first embodiment of the apparatus of the present invention.
Figure 8:
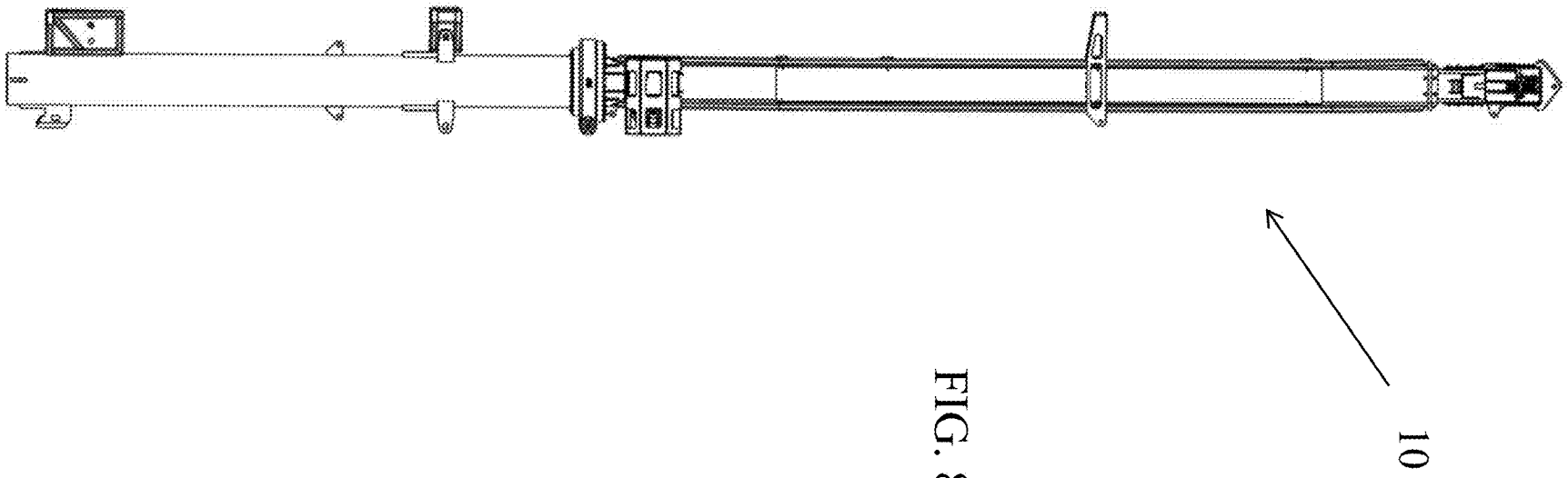
FIG. 8 is a front view of a first embodiment of the apparatus of the present invention.
Figure 9:
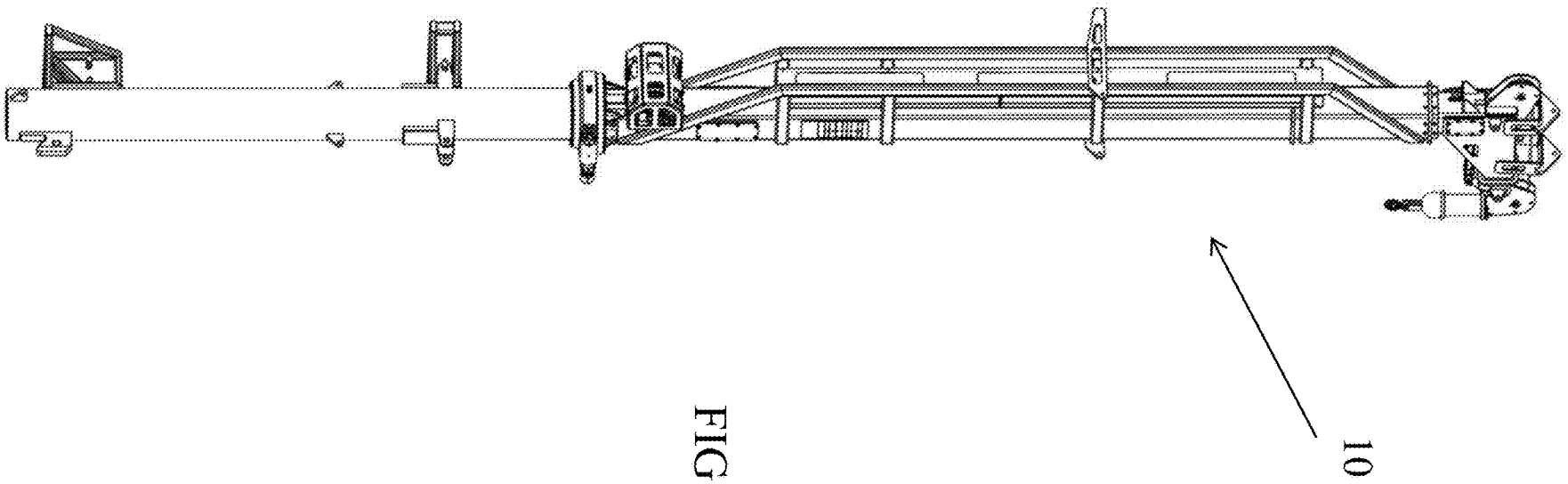
FIG. 9 is a rear perspective view of a first embodiment of the apparatus of the present invention.
Figure 10:
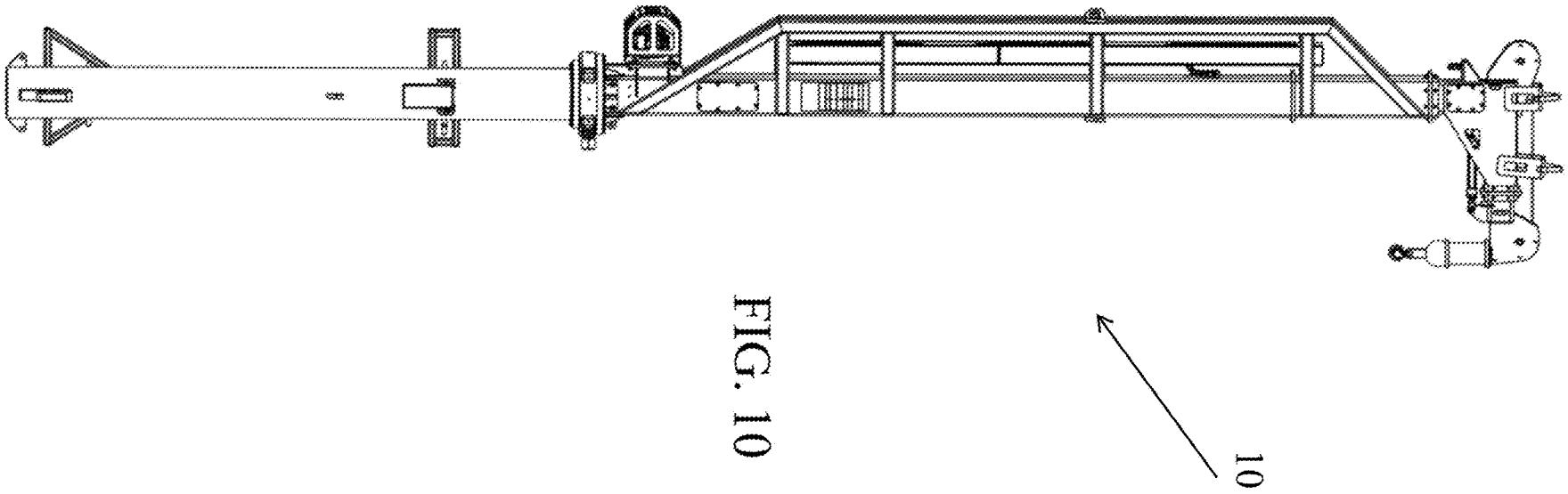
FIG. 10 is a side view of a first embodiment of the apparatus of the present invention.
Figure 11:
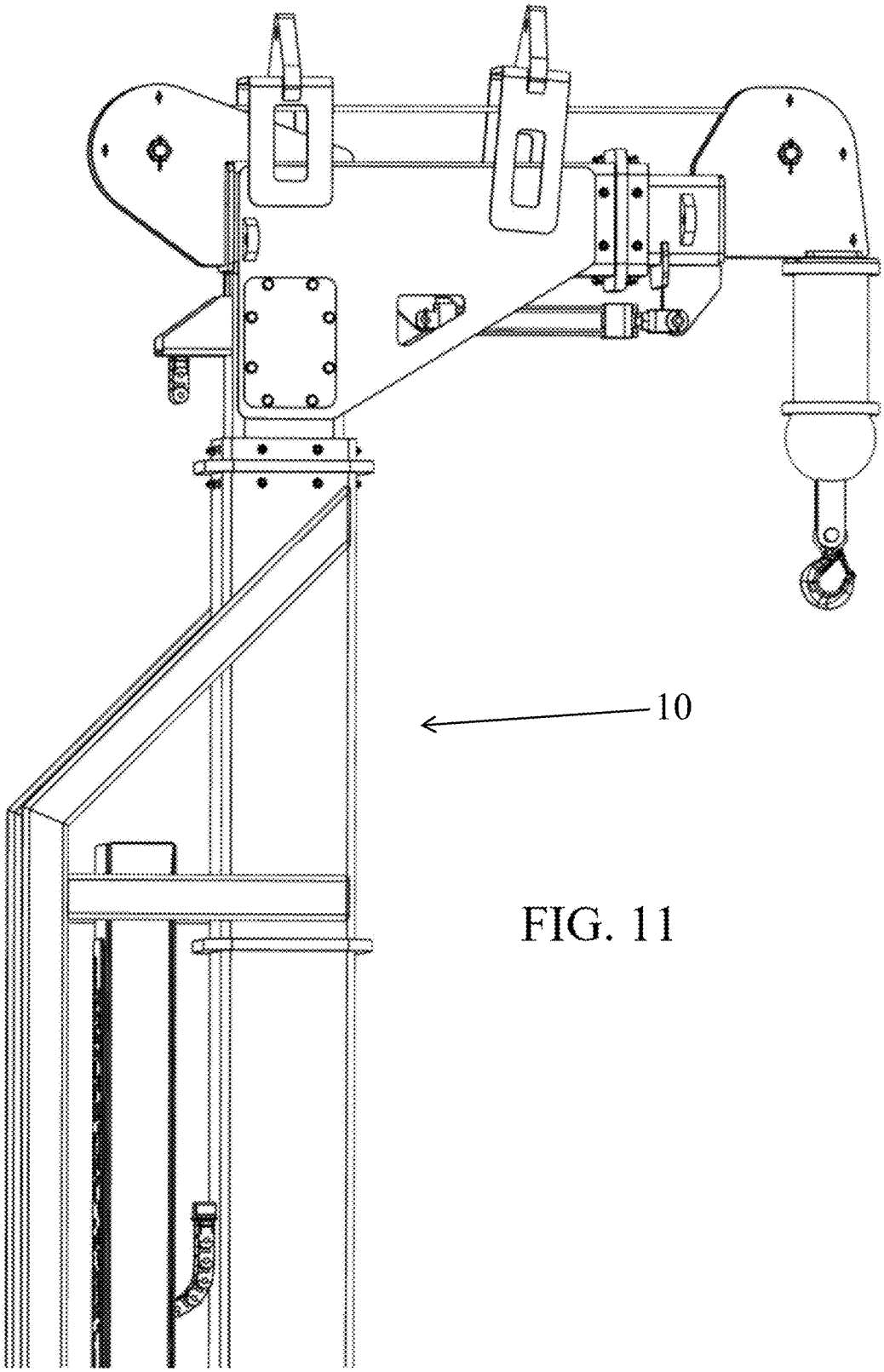
FIG. 11 is a close up of a top portion of the side view of FIG. 10.
Figure 12:
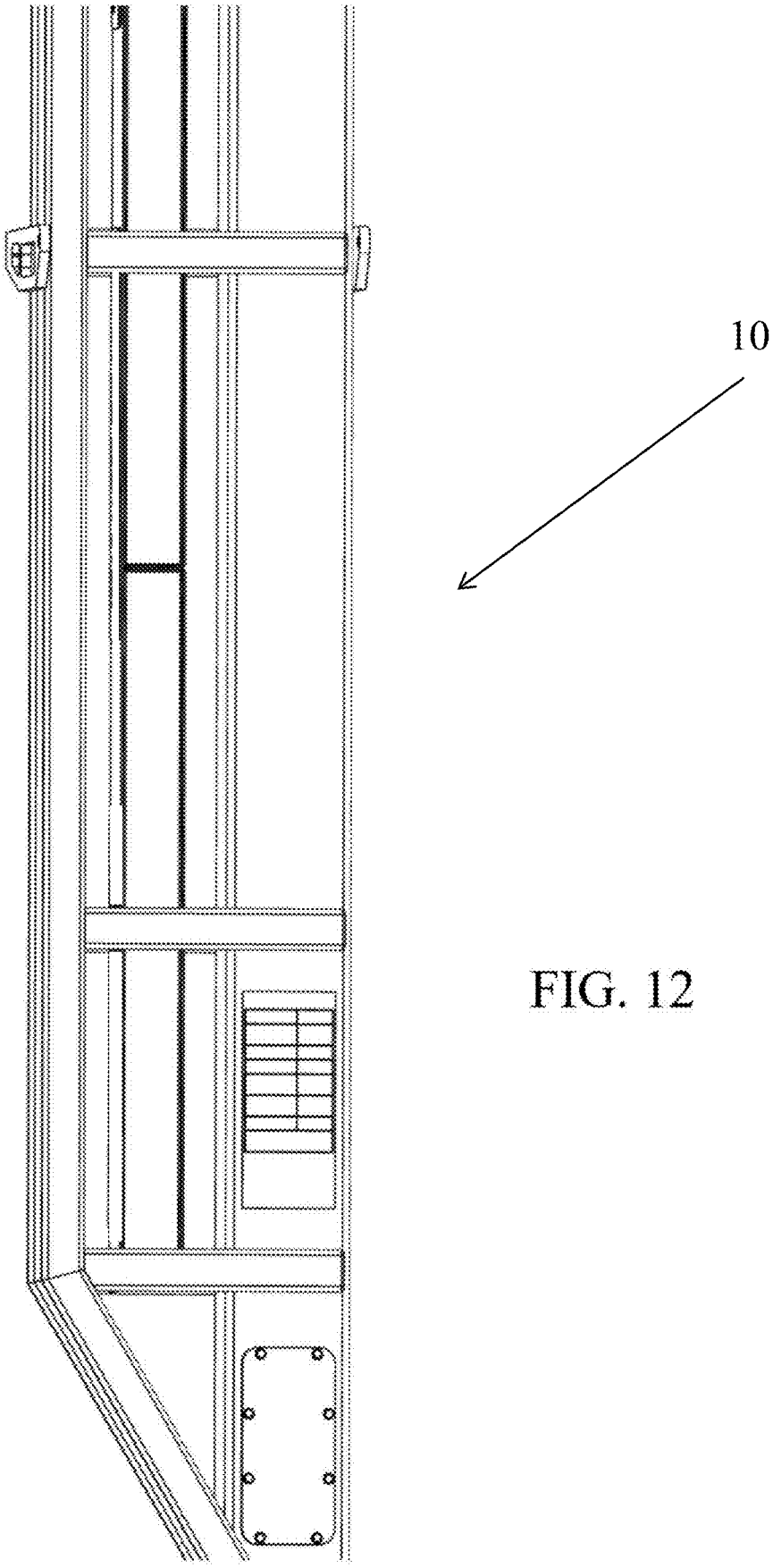
FIG. 12 is a close up of a middle portion of the side view of FIG. 10.
Figure 13:
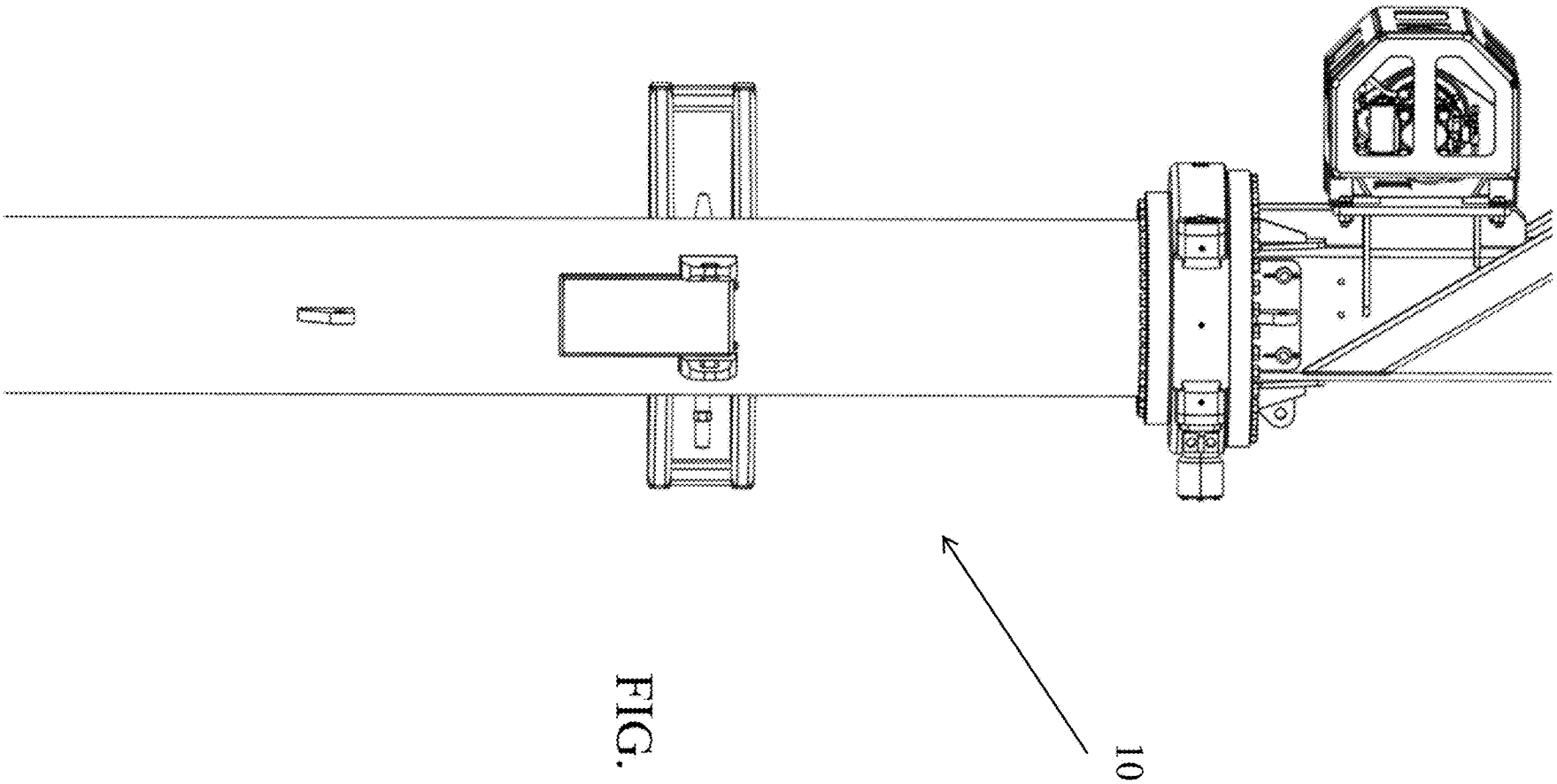
FIG. 13 is a close-up of a lower middle portion of the side view of FIG. 10.
Figure 14:
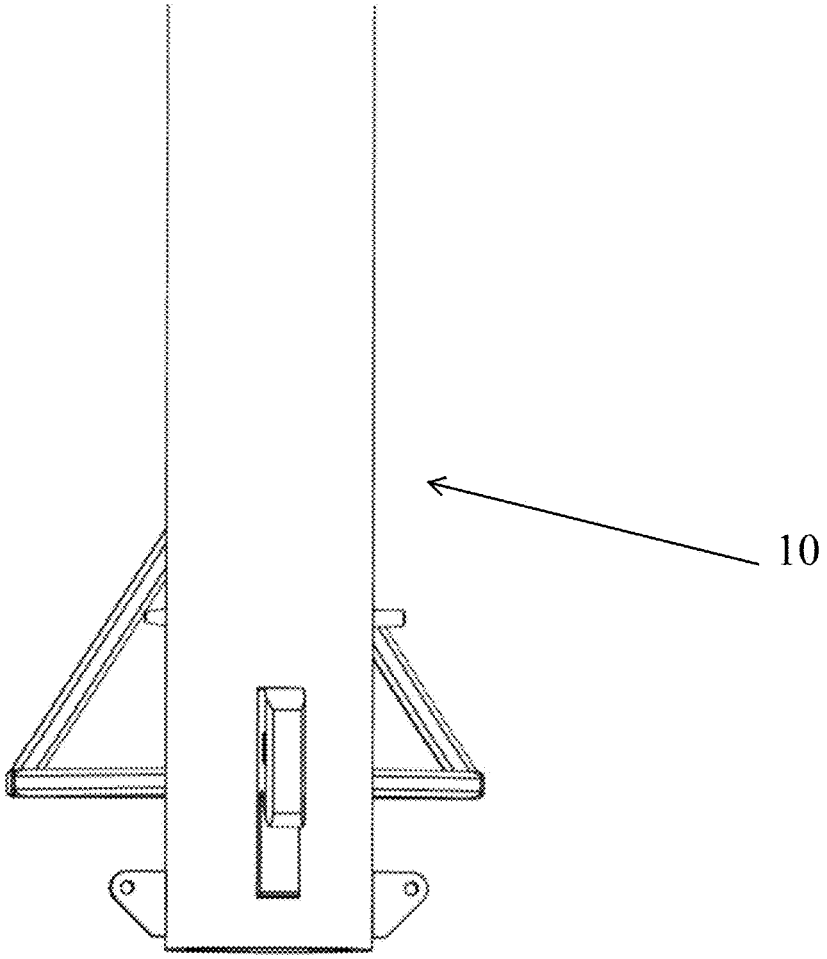
FIG. 14 is a close-up of a lower portion of the side view of FIG. 10.
Figure 15:
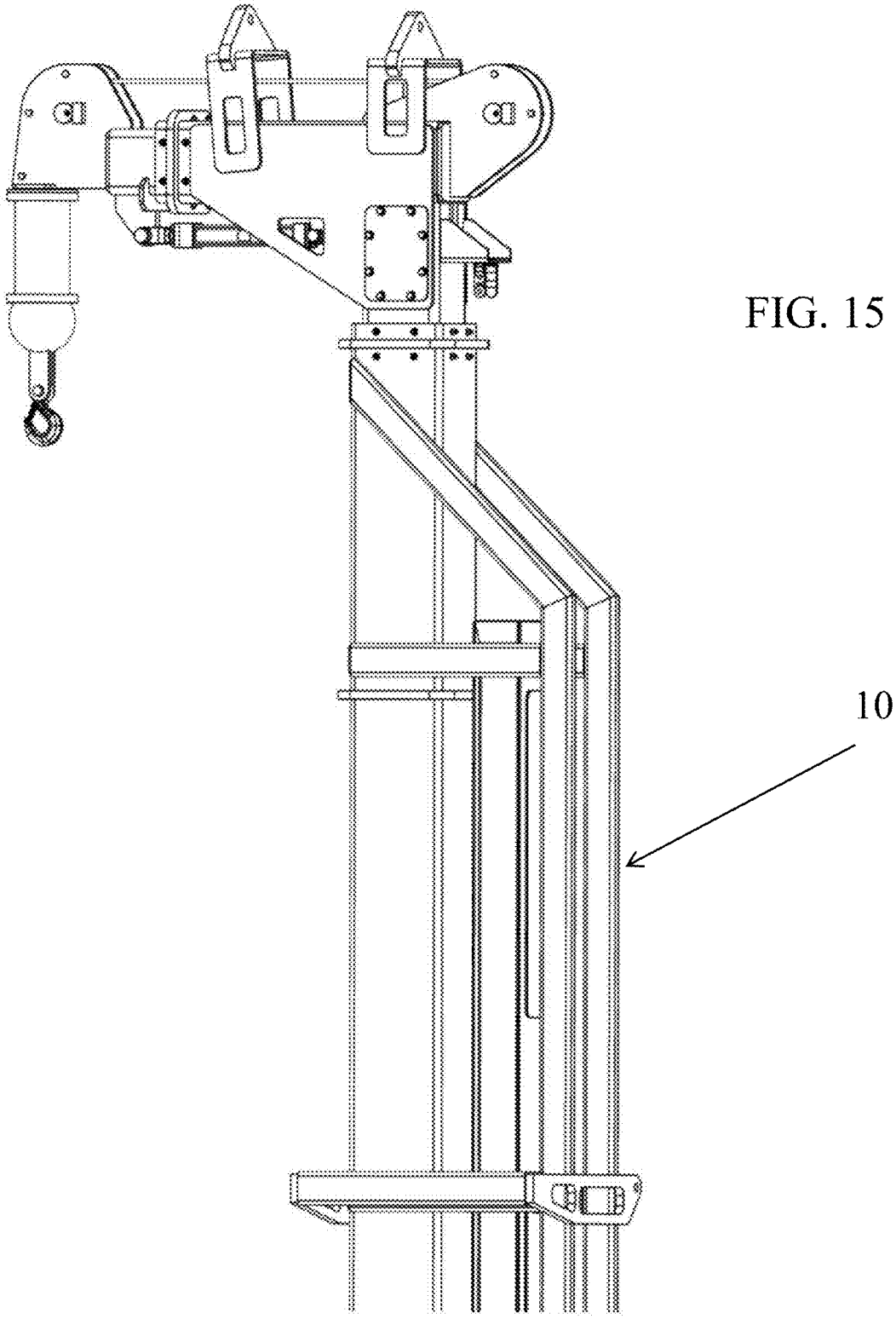
FIGS. 15-17 are partial close-up views of a side view of a first embodiment of the apparatus of the present invention.
Figure 16:
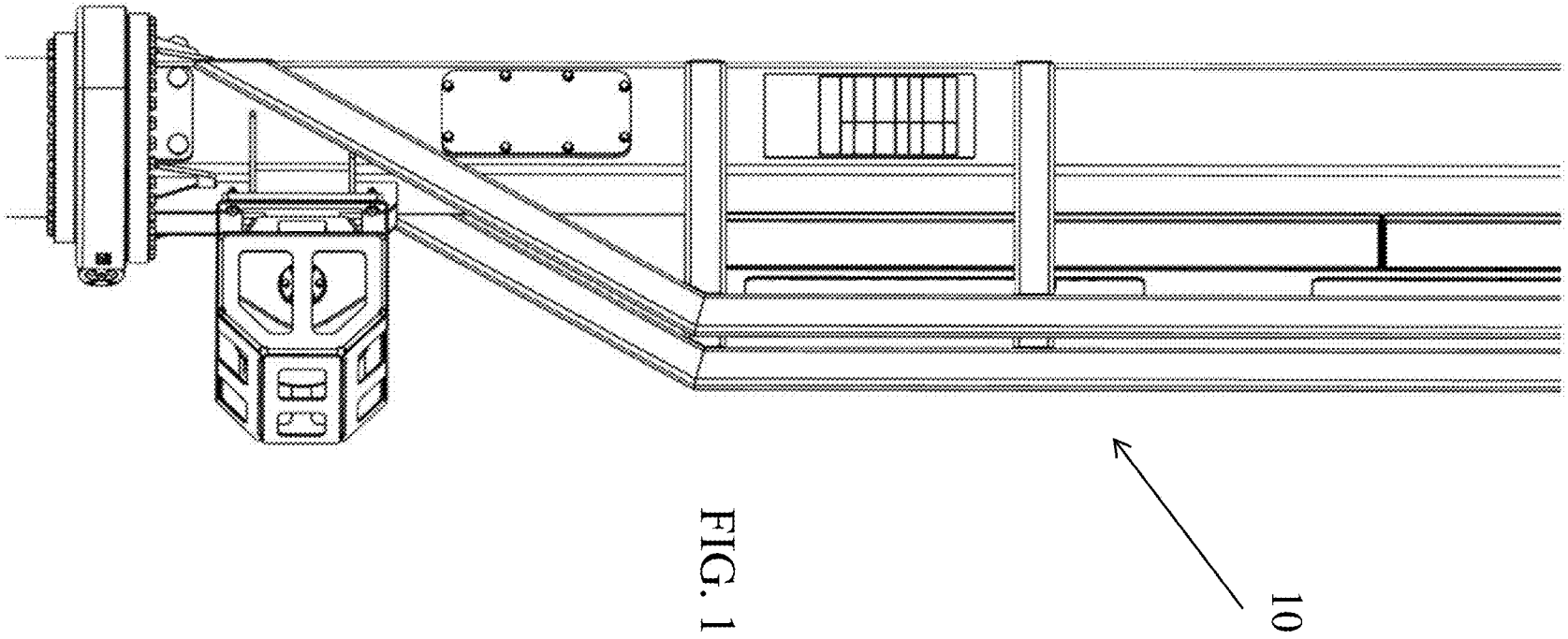
Figure 17:
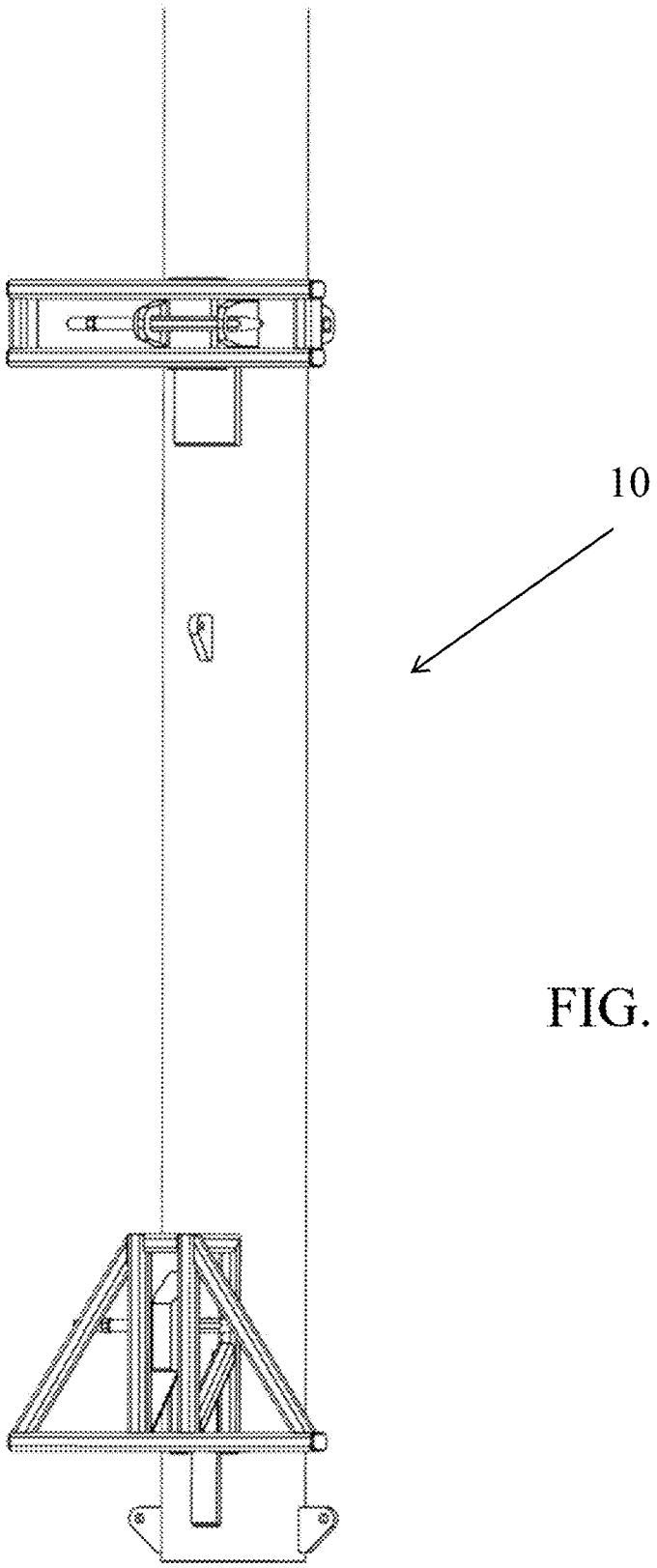
Figure 18:
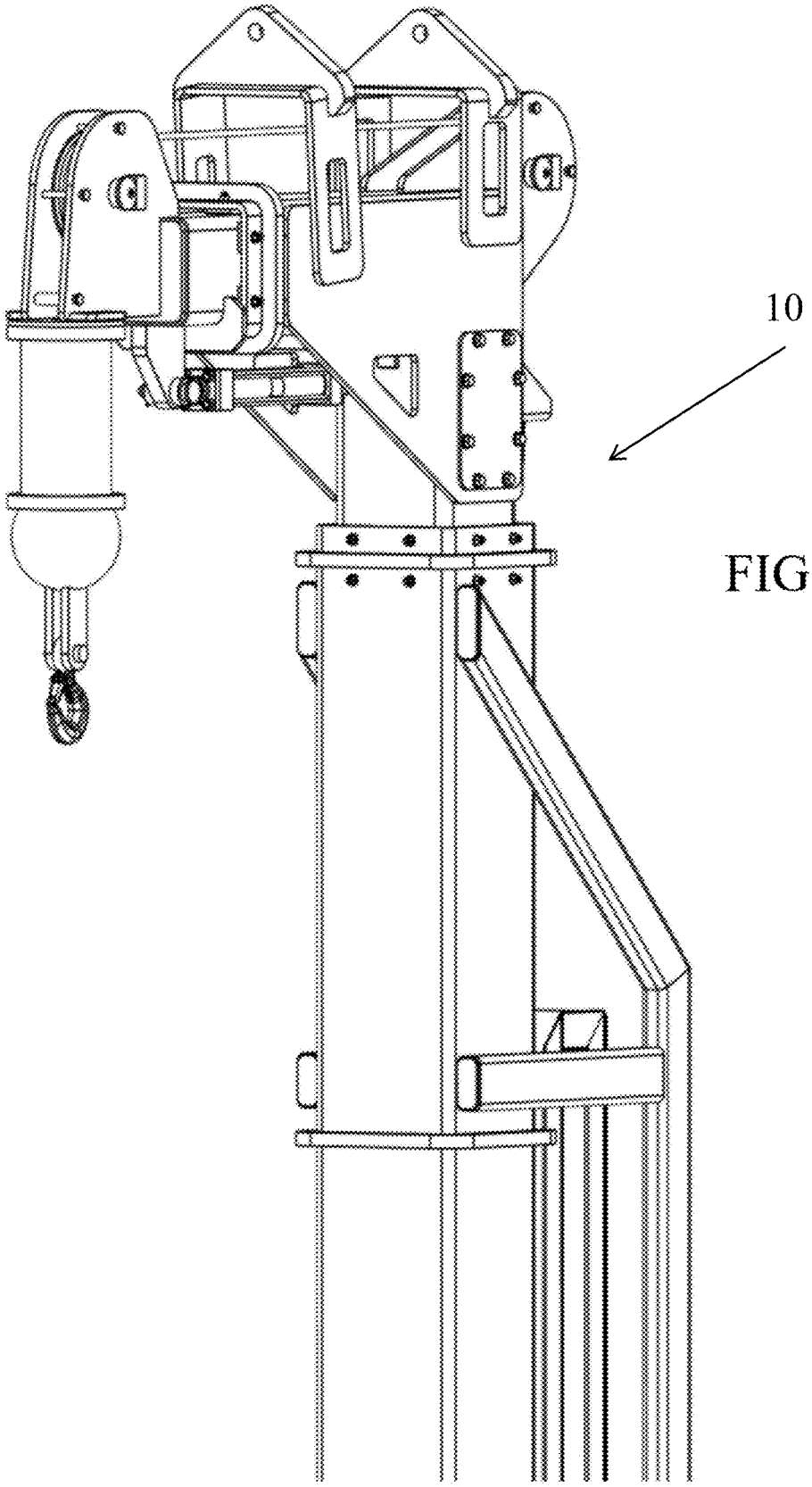
FIGS. 18-21 are partial close-up views of a front perspective view of a first embodiment of the apparatus of the present invention.
Figure 19:
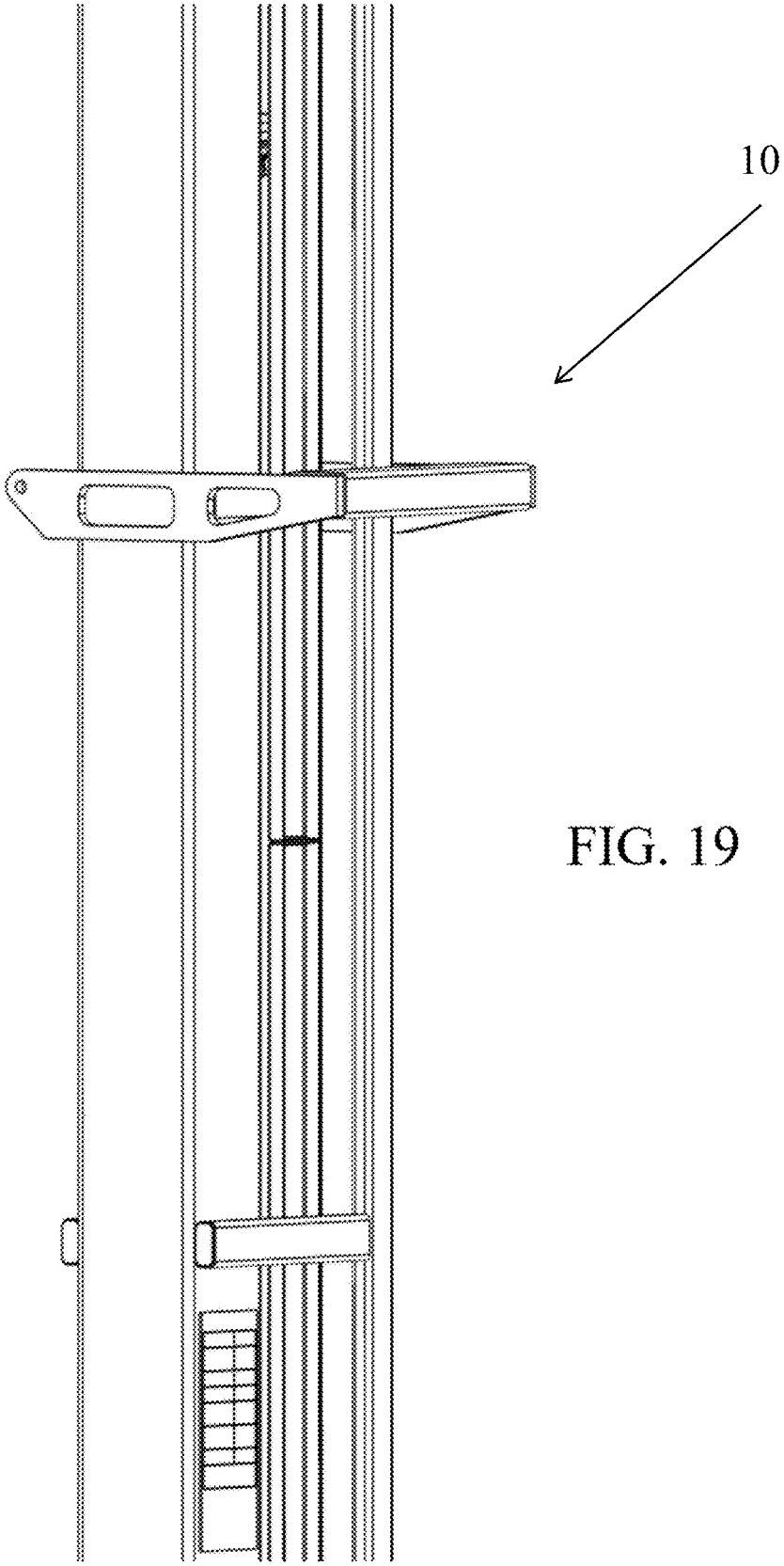
Figure 20:
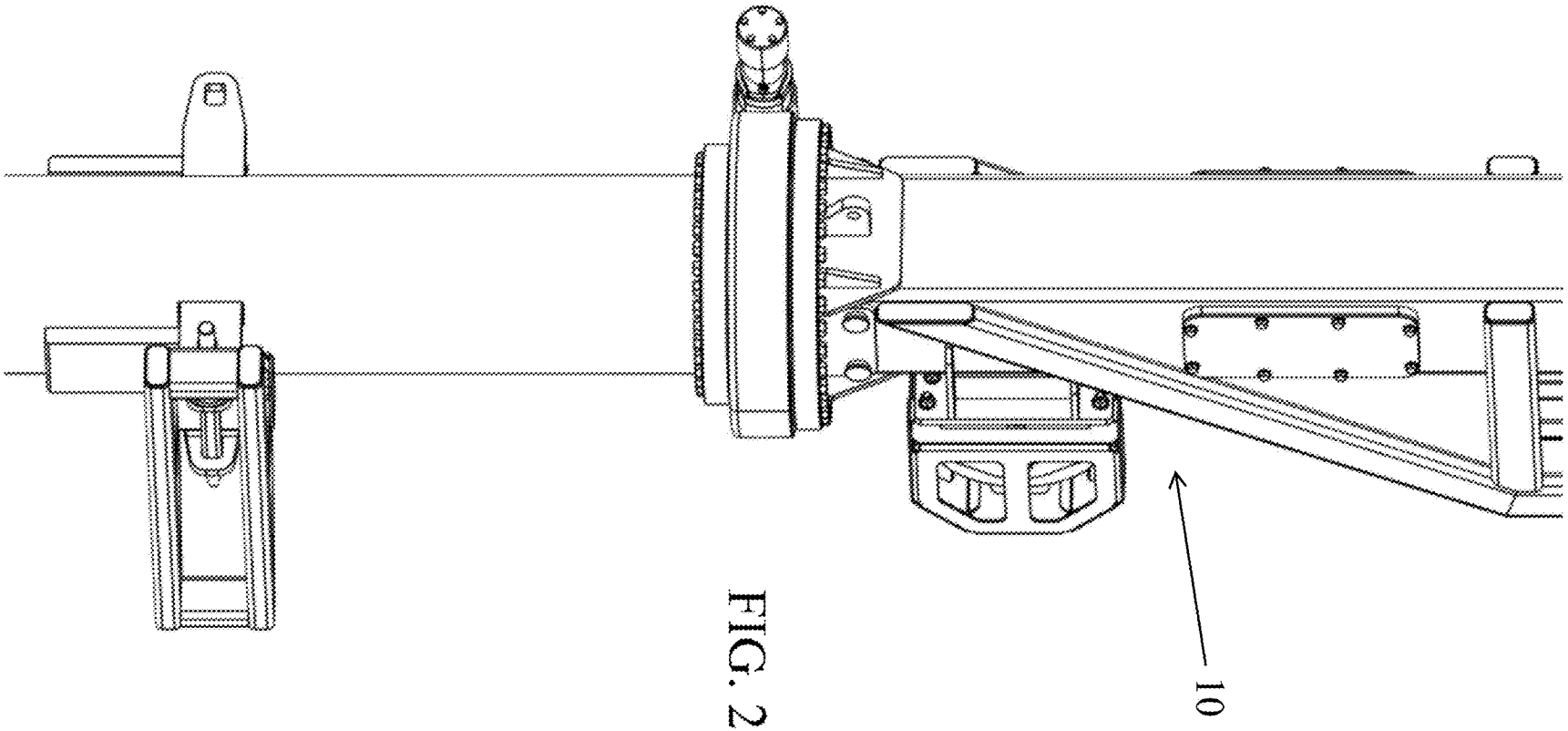
Figure 21:
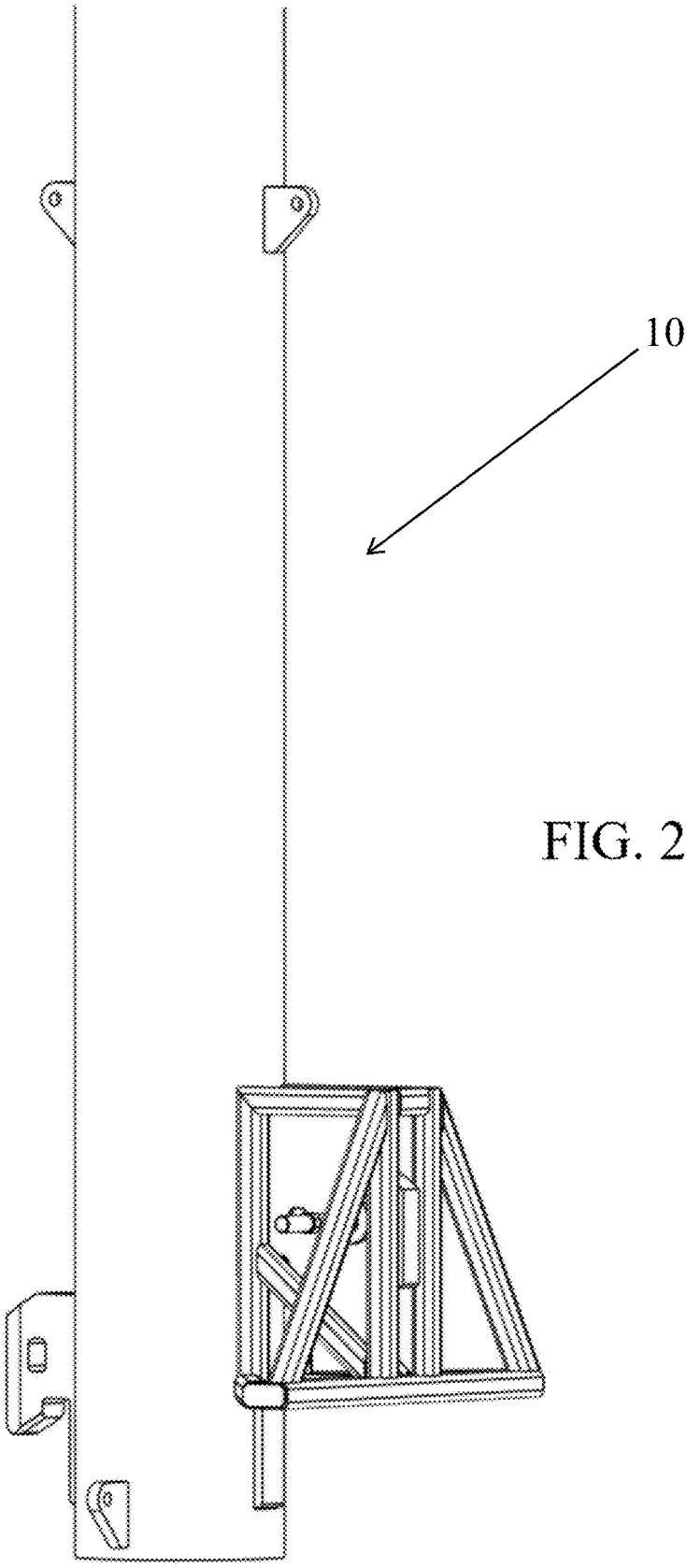
Figure 22:
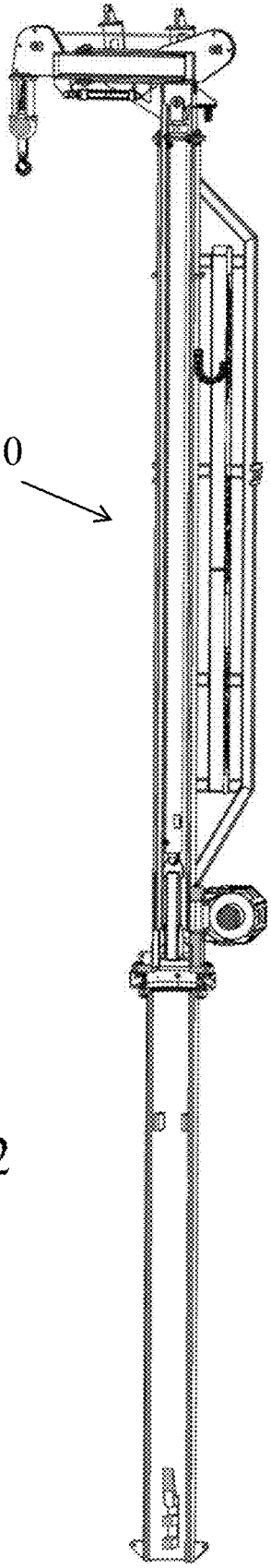
FIGS. 22 and 23 are side cutaway views of a first embodiment of the apparatus of the present invention.
Figure 23:
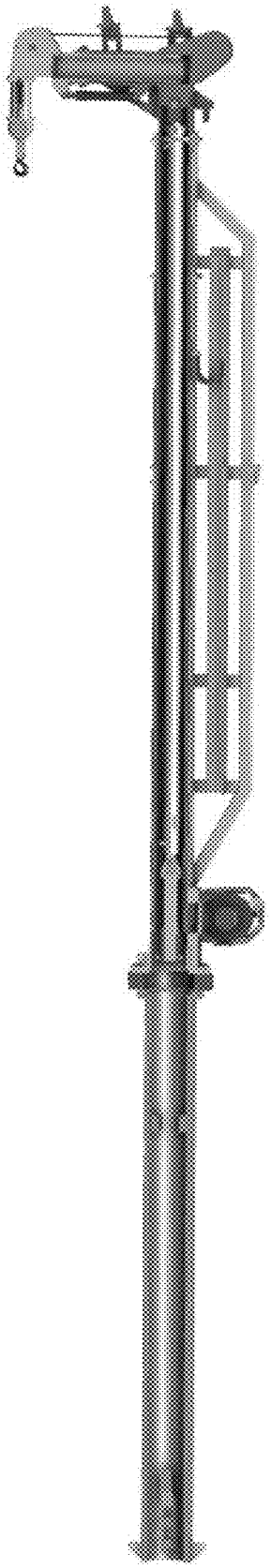
Figure 24:
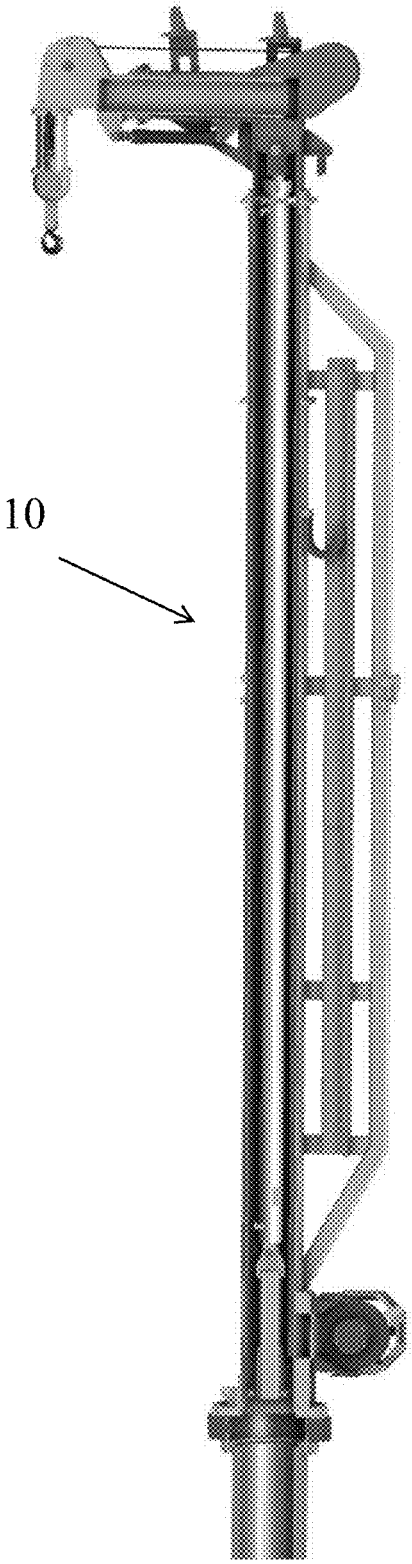
FIGS. 24-27 are close-up partial views of the side cutaway views of FIGS. 22 and 23.
Figure 25:
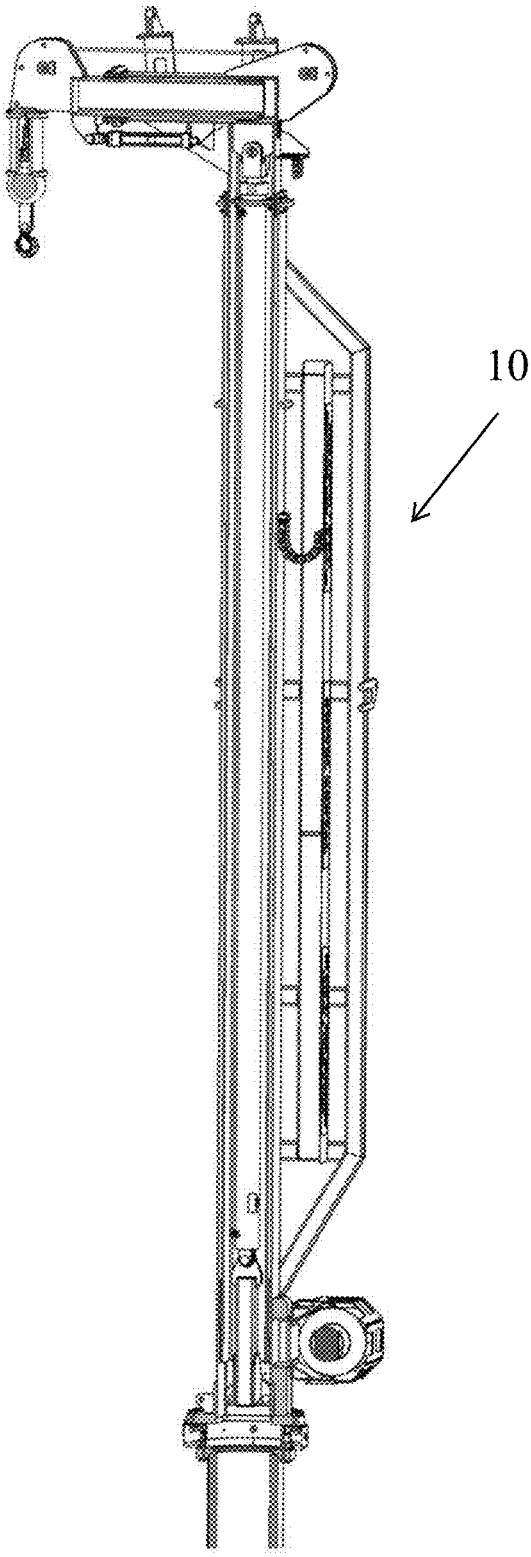
Figure 26:
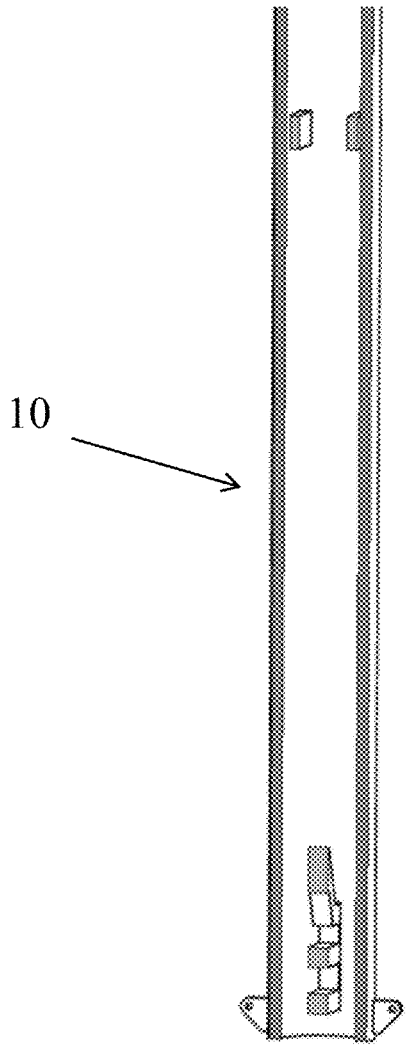
Figure 27:
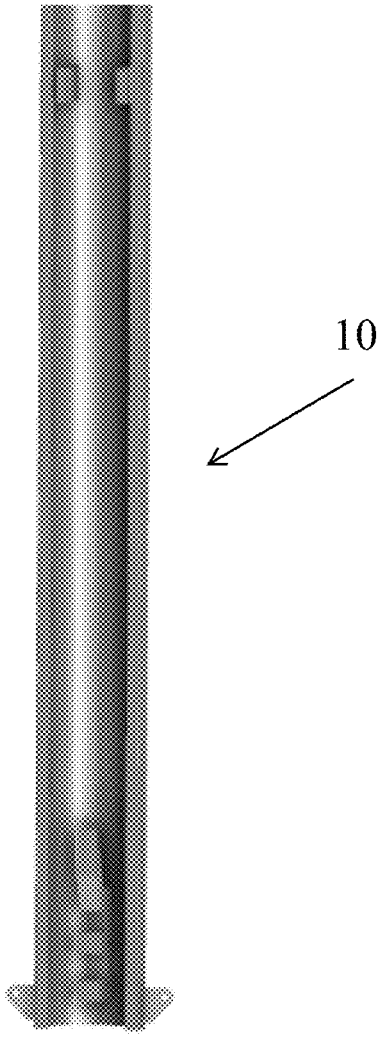
Figure 28:
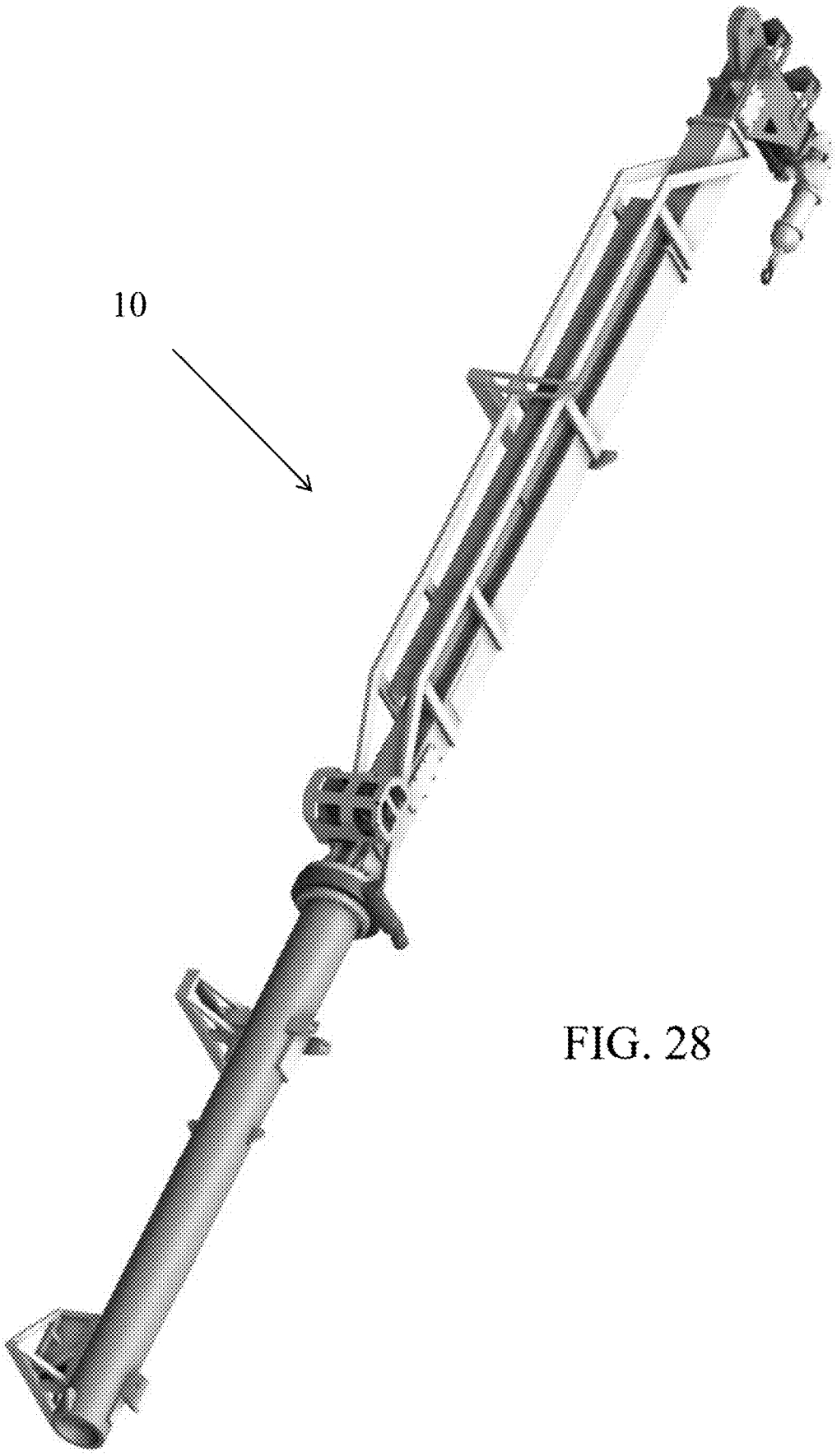
FIG. 28 is a perspective view of a first embodiment of the apparatus of the present invention.
Figure 29:
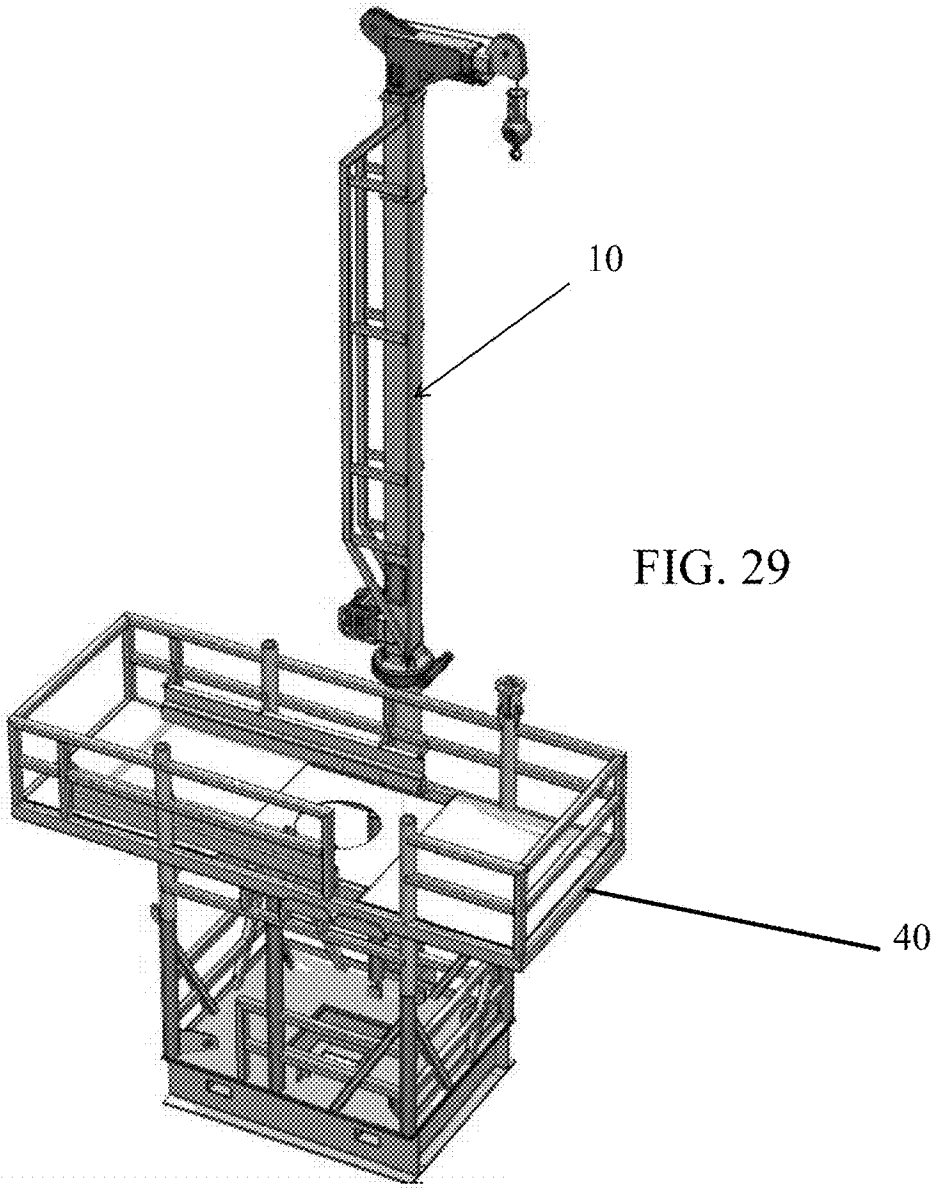
FIG. 29 is a view of an embodiment of the apparatus of the present invention.
Figure 30:
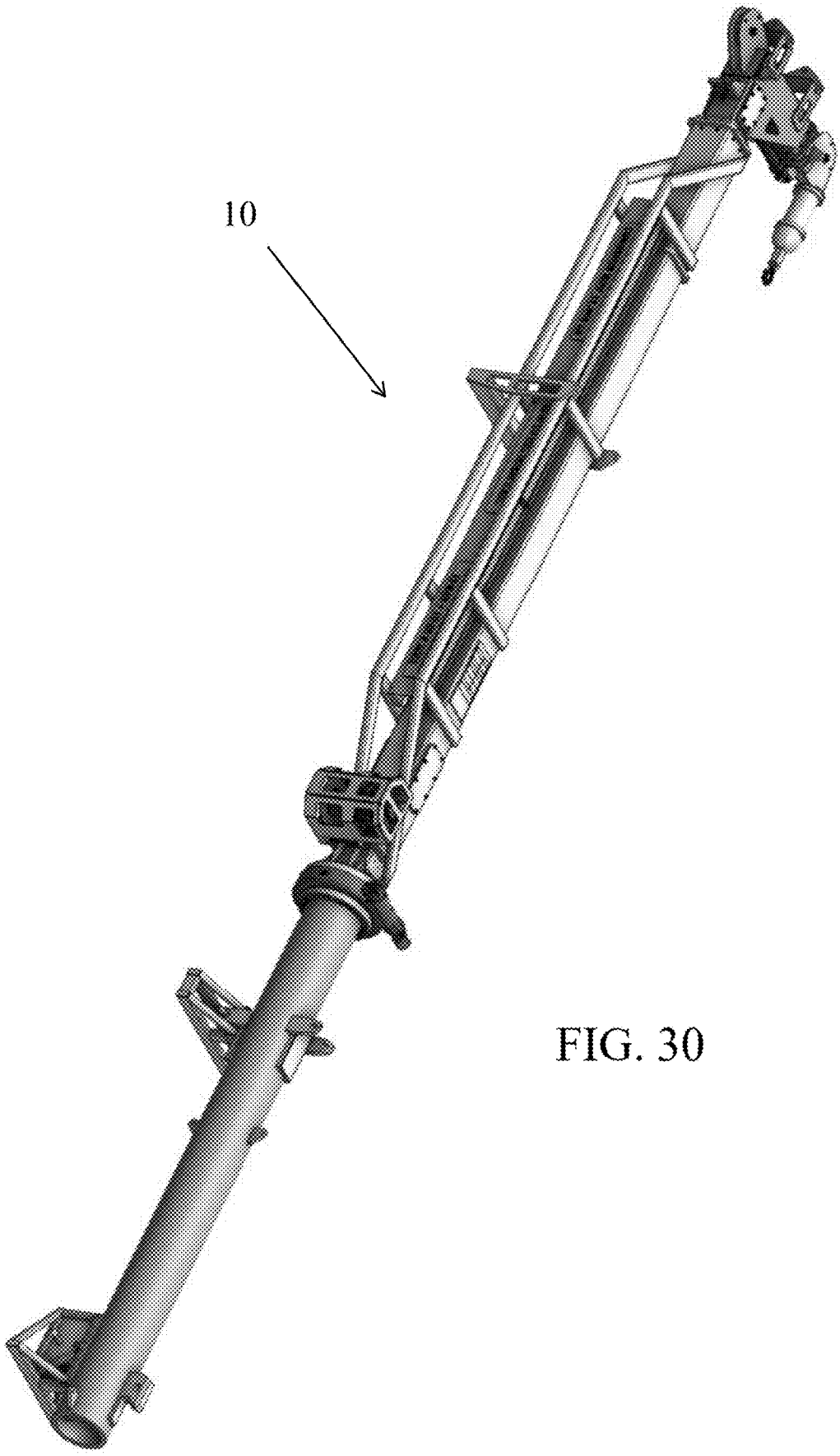
FIG. 30 is a perspective view of a first embodiment of the apparatus of the present invention.
Figure 31:
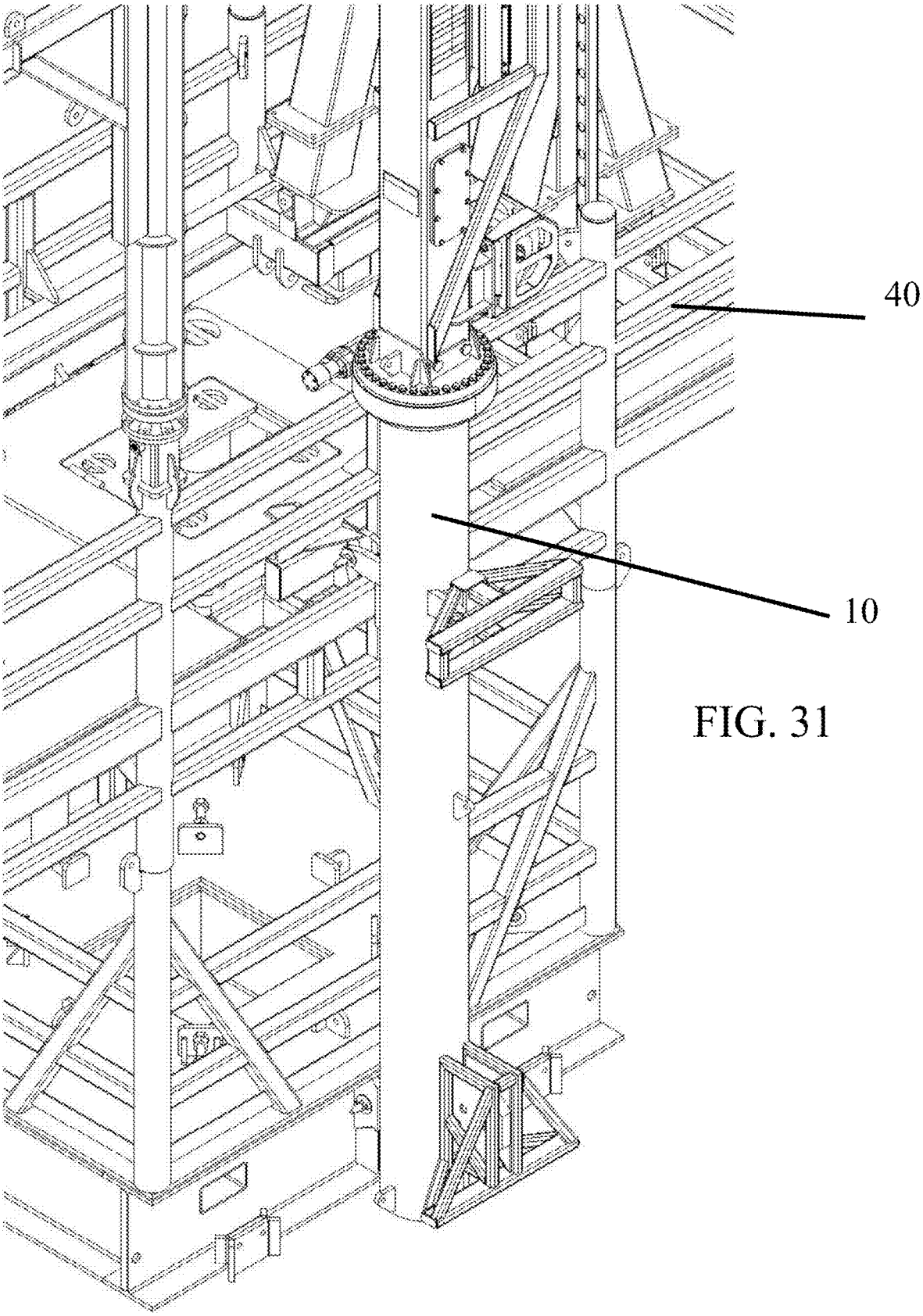
FIG. 31 is close-up partial view of FIG. 42 showing the first embodiment of the apparatus of the present invention attached to a workbasket.
Figure 32:
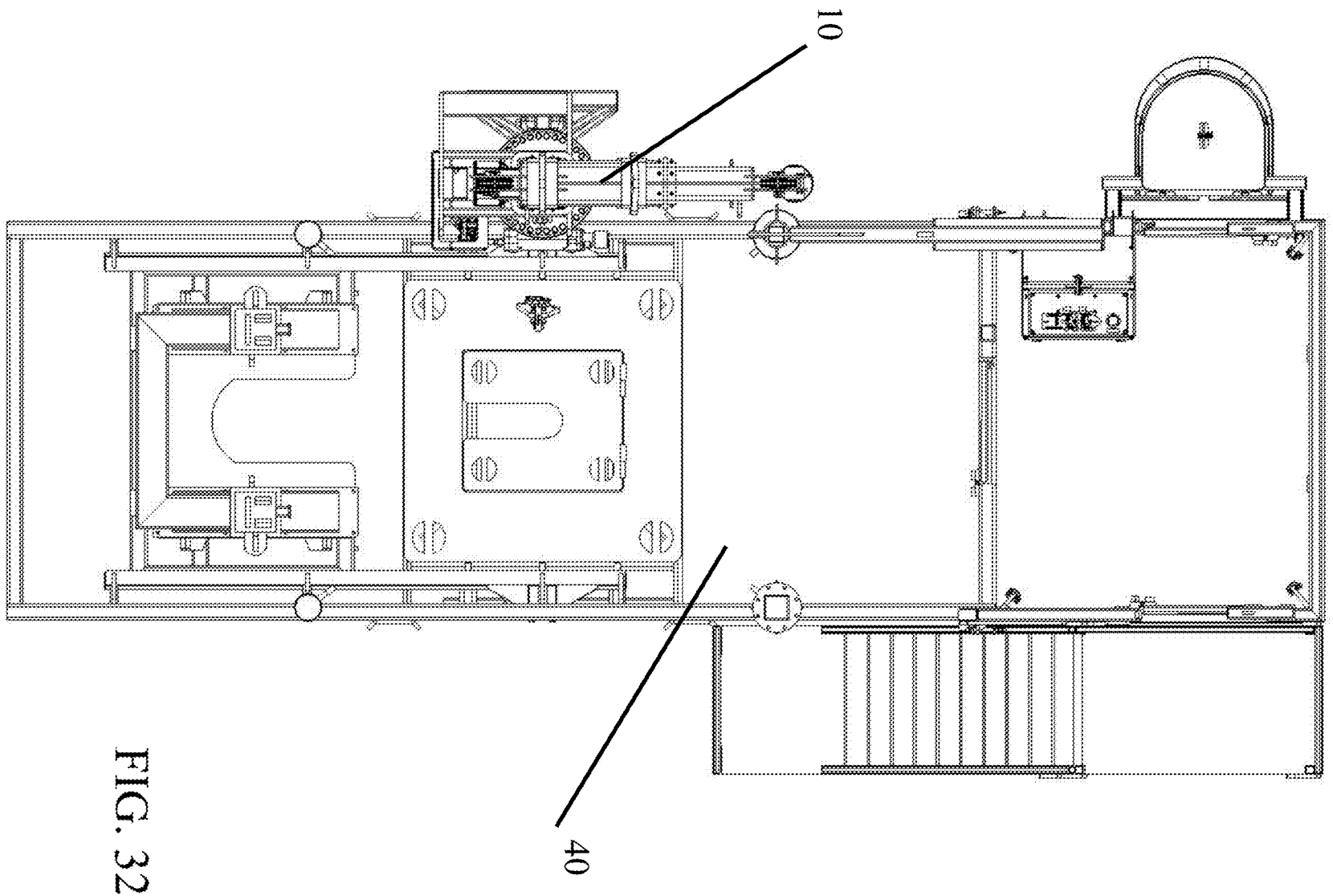
FIG. 32 is a top view of a first embodiment of the apparatus of the present invention attached to a workbasket.
Figure 33:
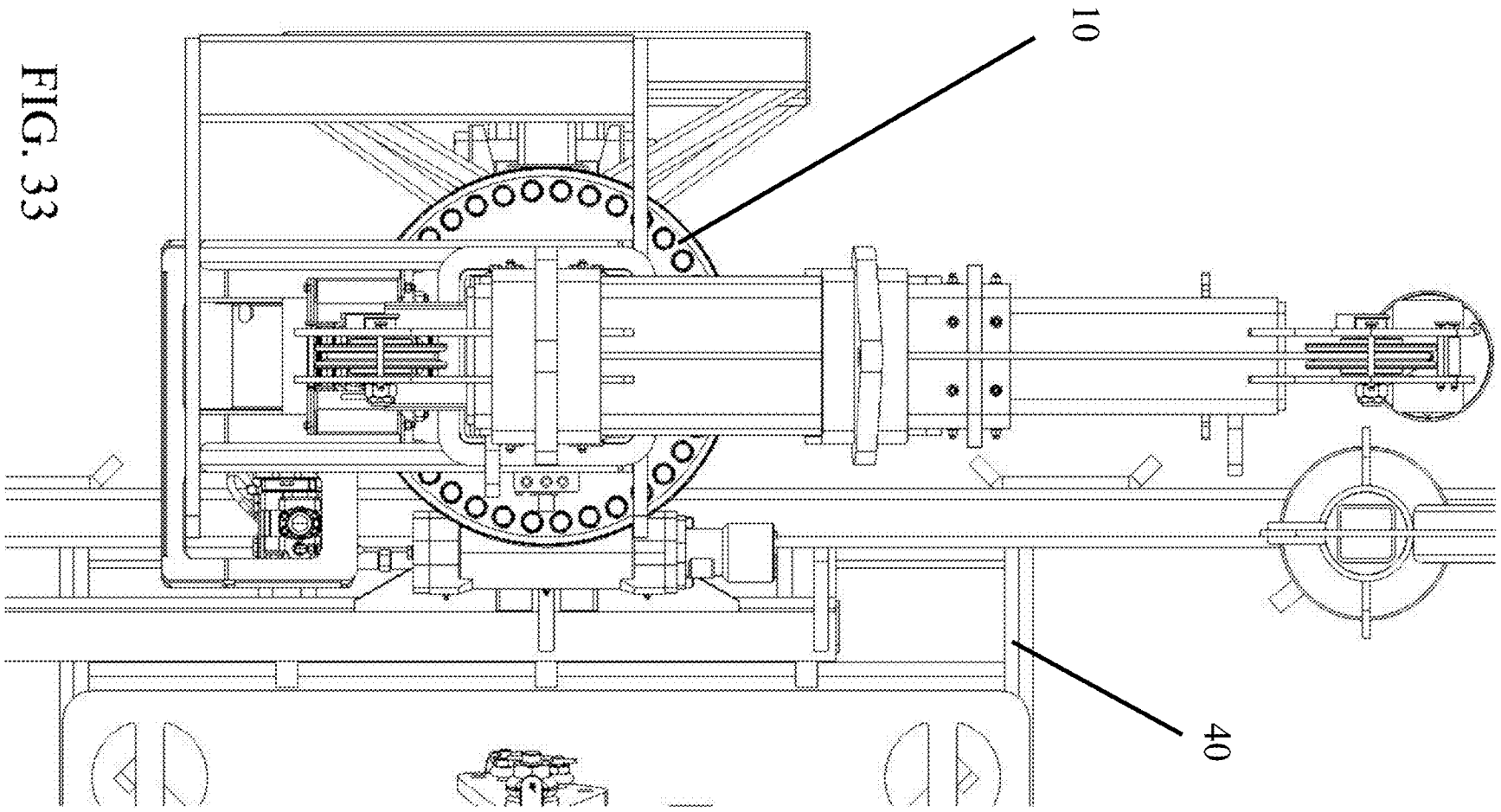
FIG. 33 is a close-up partial view of FIG. 32 showing the first embodiment of the apparatus of the present invention attached to a workbasket.
Figure 34:
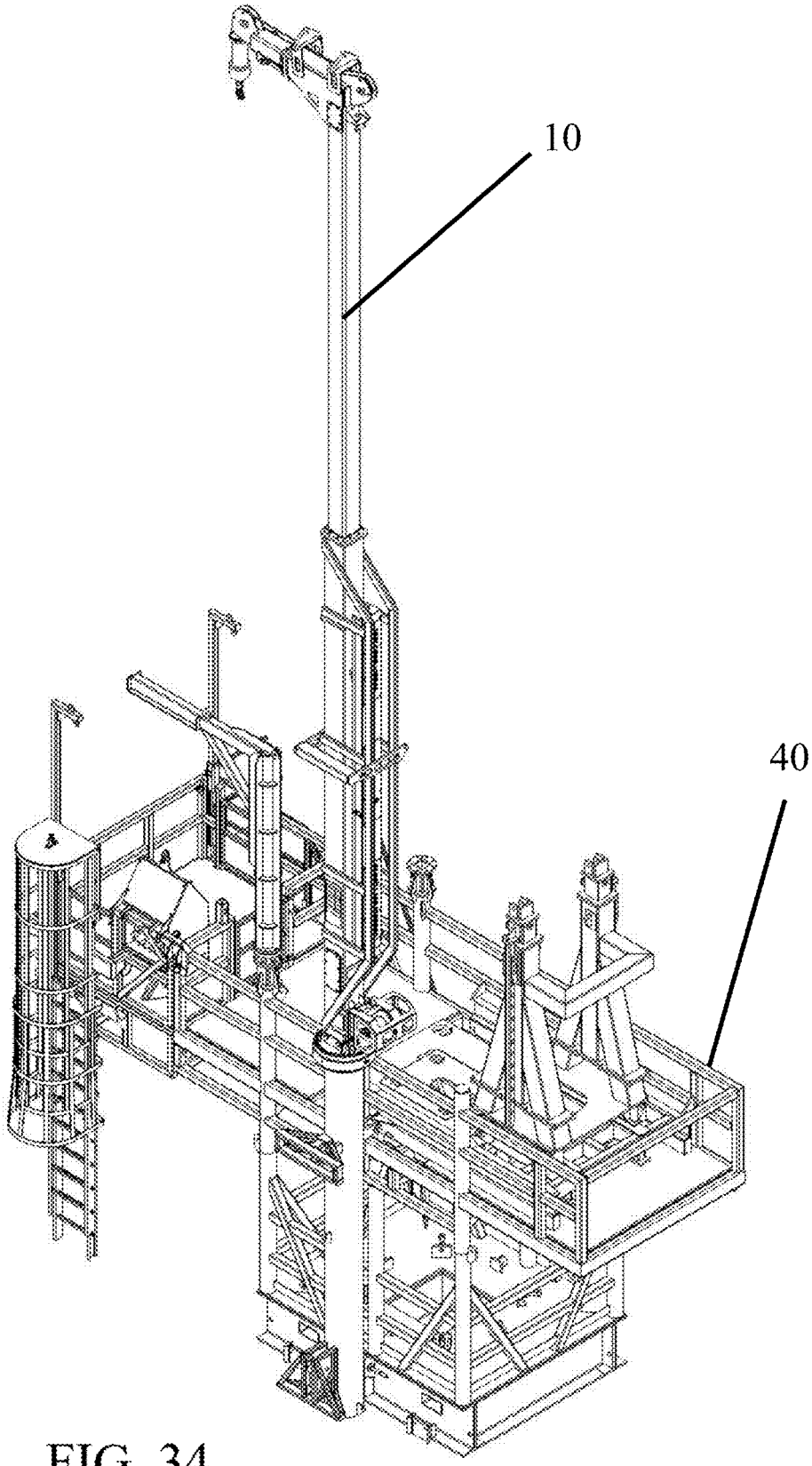
FIG. 34 is a perspective view of a first embodiment of the apparatus of the present invention attached to a workbasket.
Figure 35:
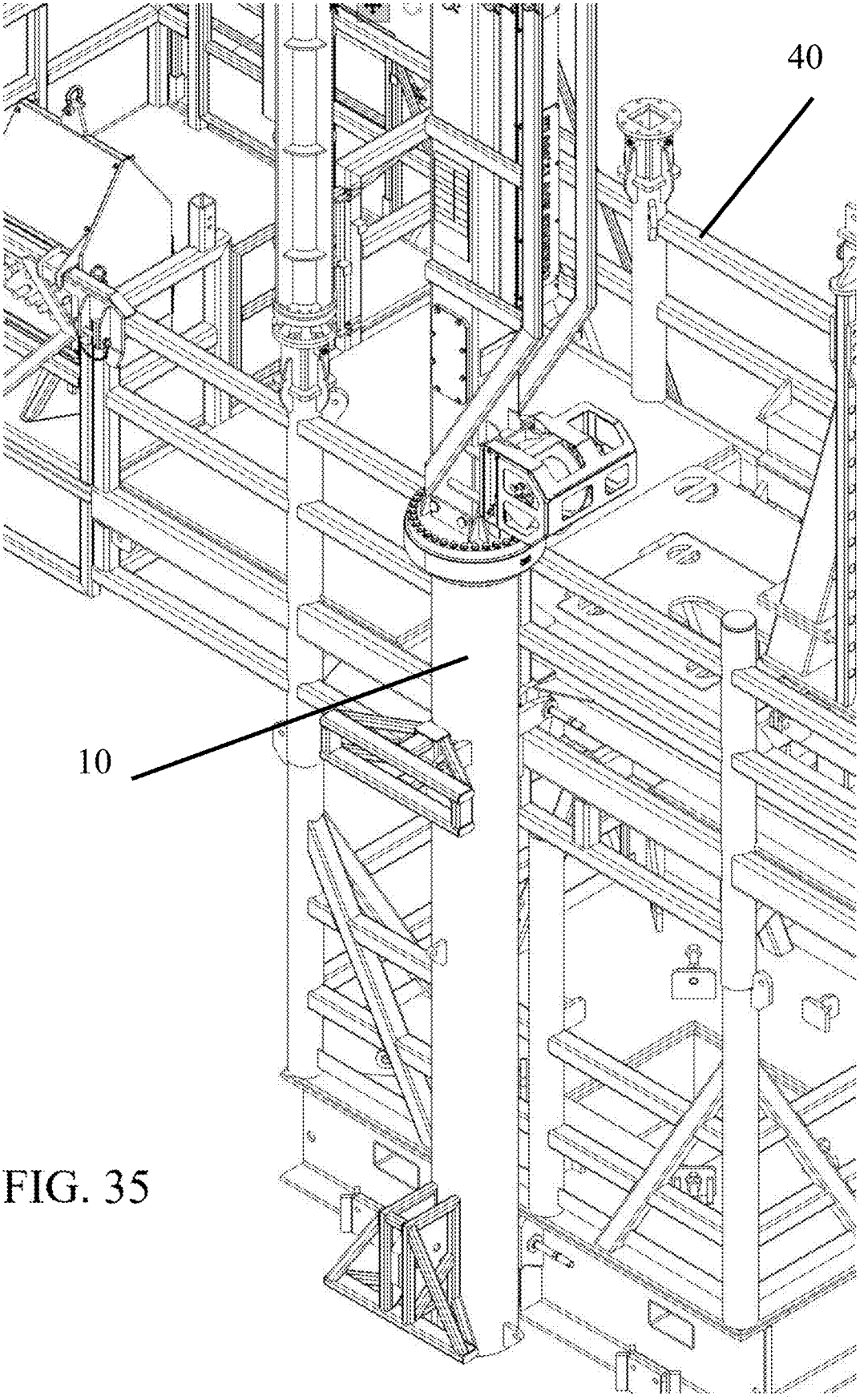
FIG. 35 is a close-up partial view of FIG. 34 showing the first embodiment of the apparatus of the present invention attached to a workbasket.
Figure 36:
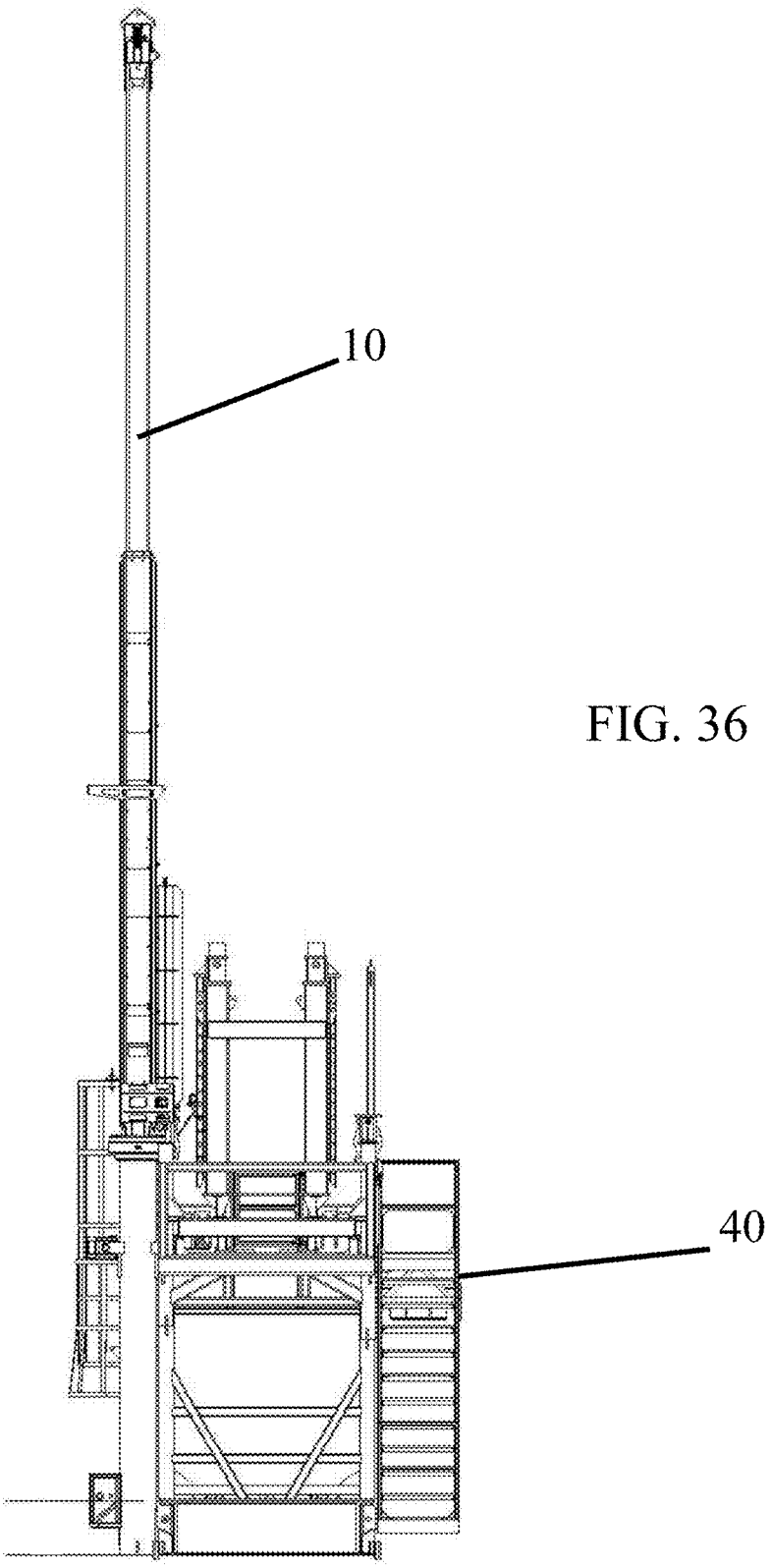
FIG. 36 is a front perspective view of a first embodiment of the apparatus of the present invention attached to a workbasket.
Figure 37:
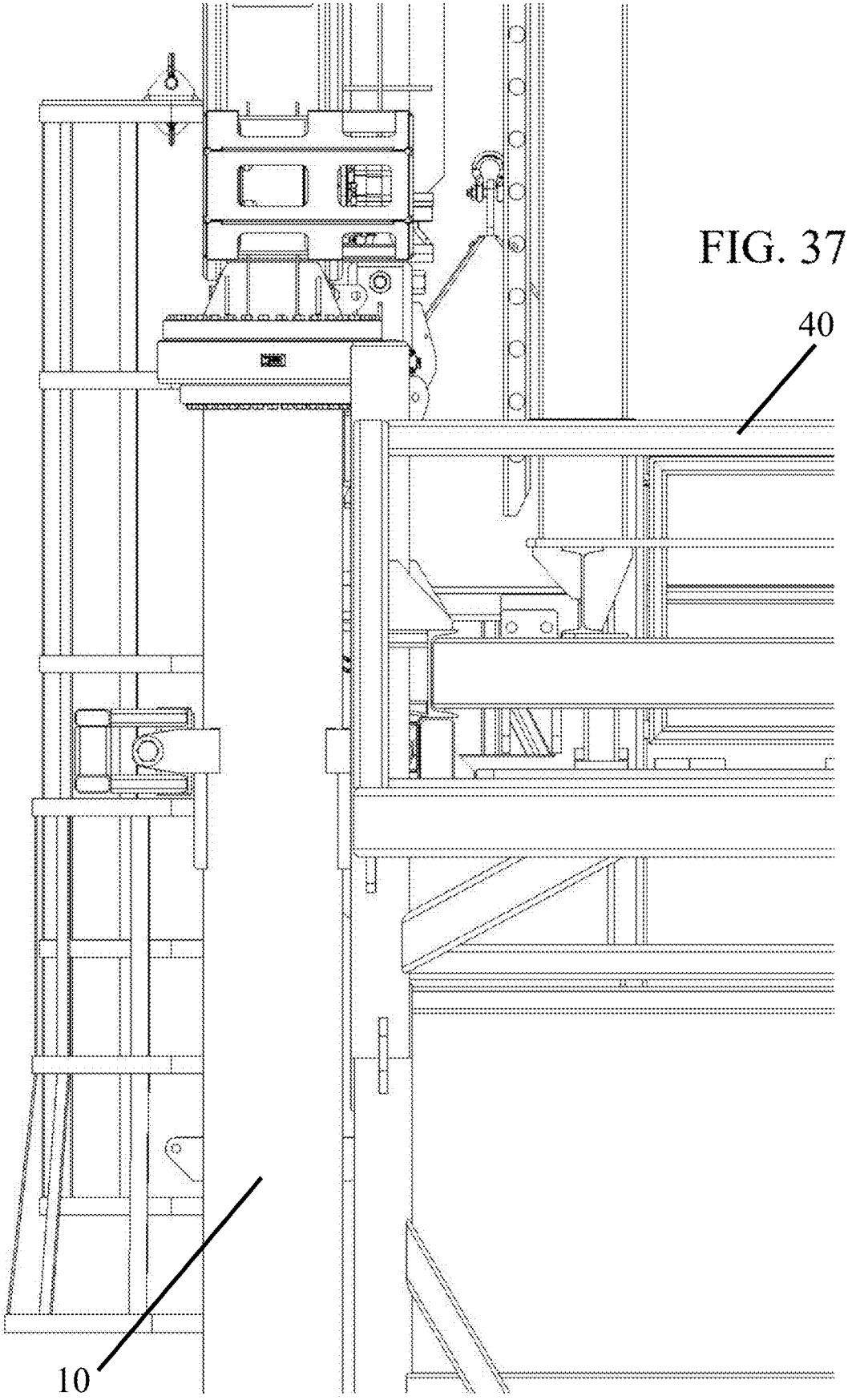
FIG. 37 is a close-up partial view of FIG. 36 showing the first embodiment of the apparatus of the present invention attached to a workbasket.
Figure 38:
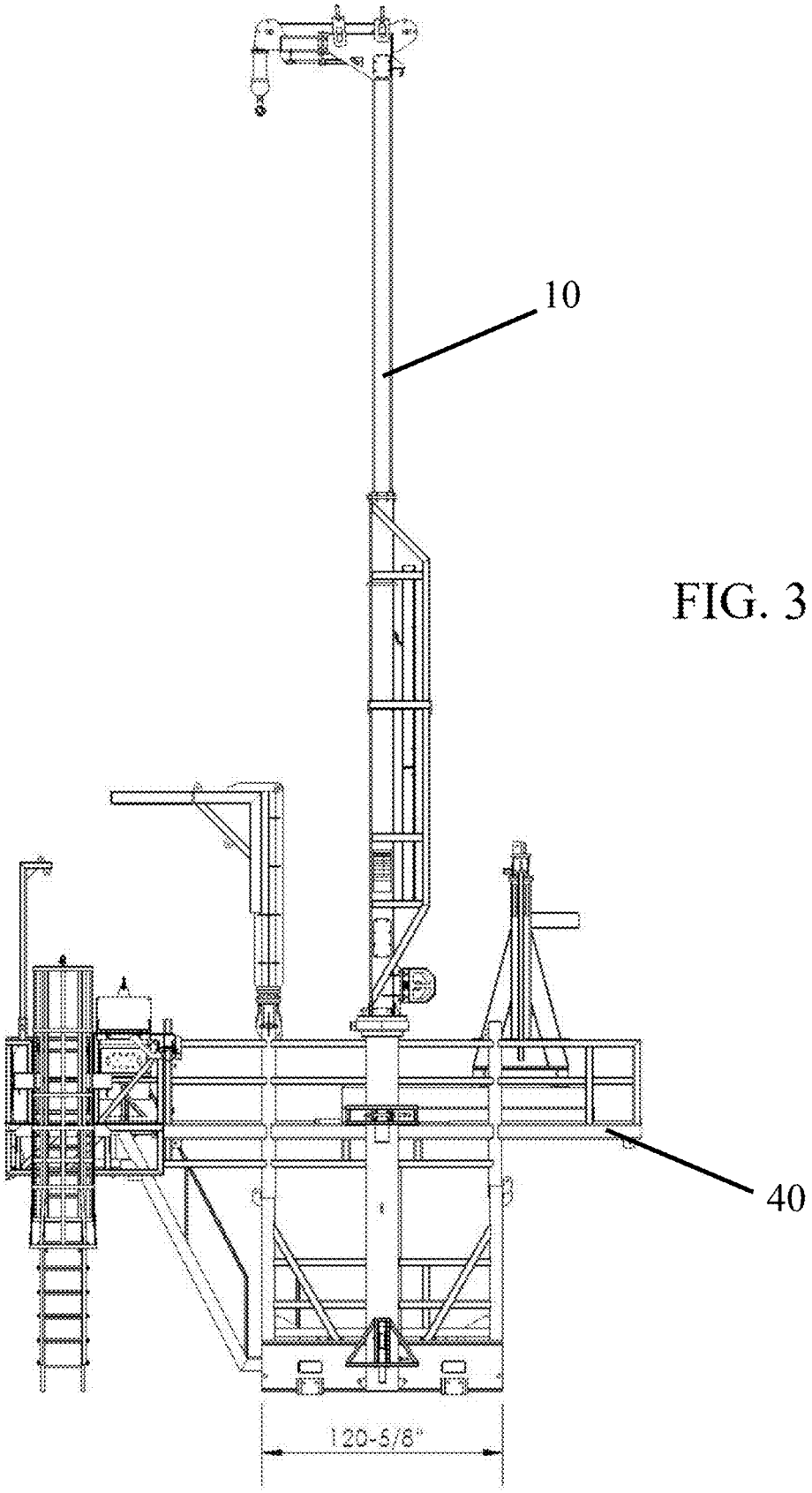
FIG. 38 is a side view of a first embodiment of the apparatus of the present invention attached to a workbasket.
Figure 39:
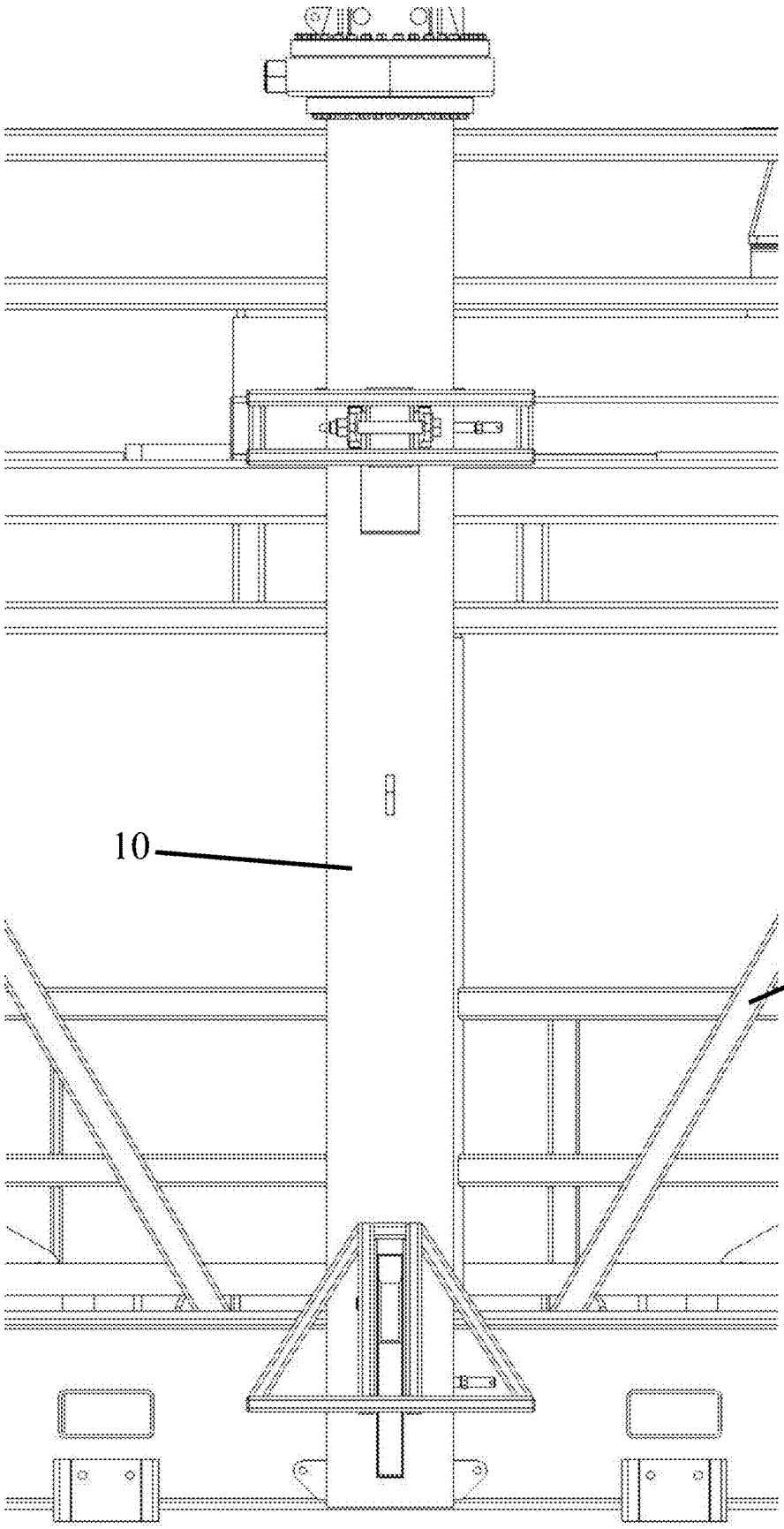
FIG. 39 is a close-up partial view of FIG. 38 showing the first embodiment of the apparatus of the present invention attached to a workbasket.
Figure 40:
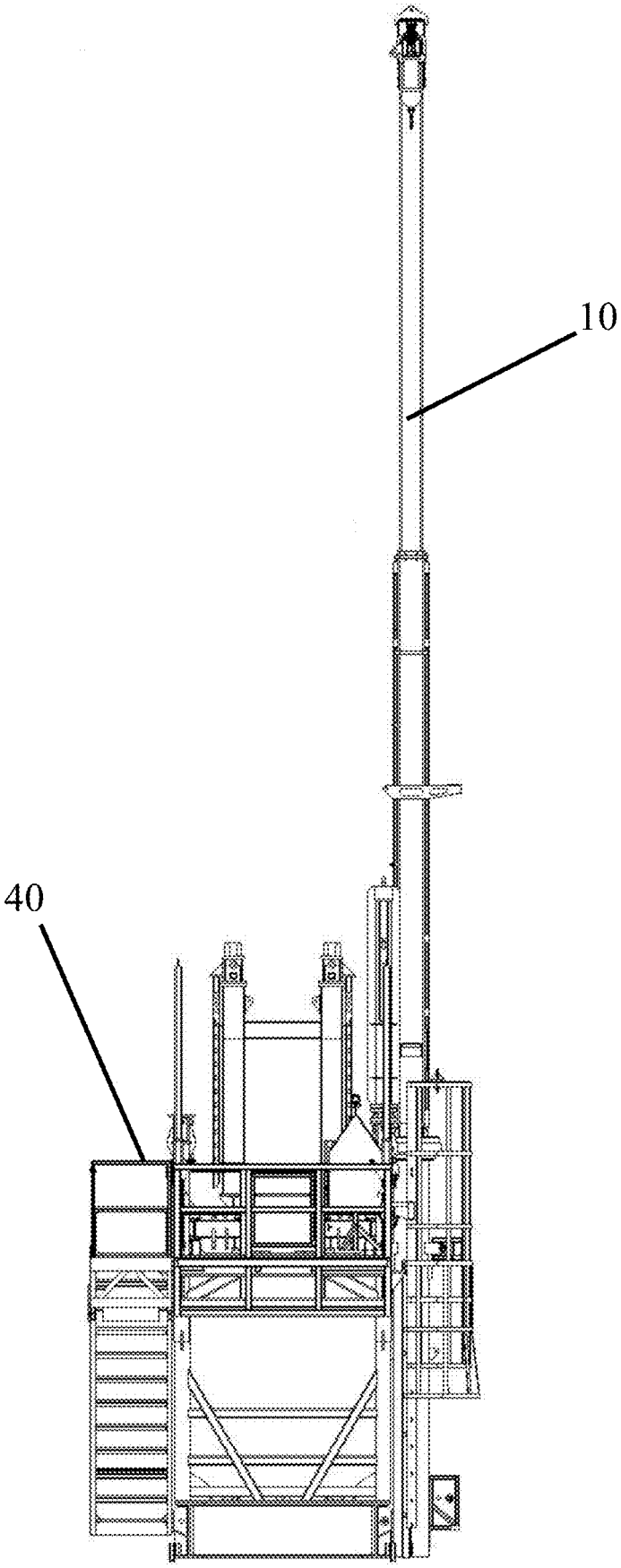
FIG. 40 is a rear view of a first embodiment of the apparatus of the present invention attached to a workbasket.
Figure 41:
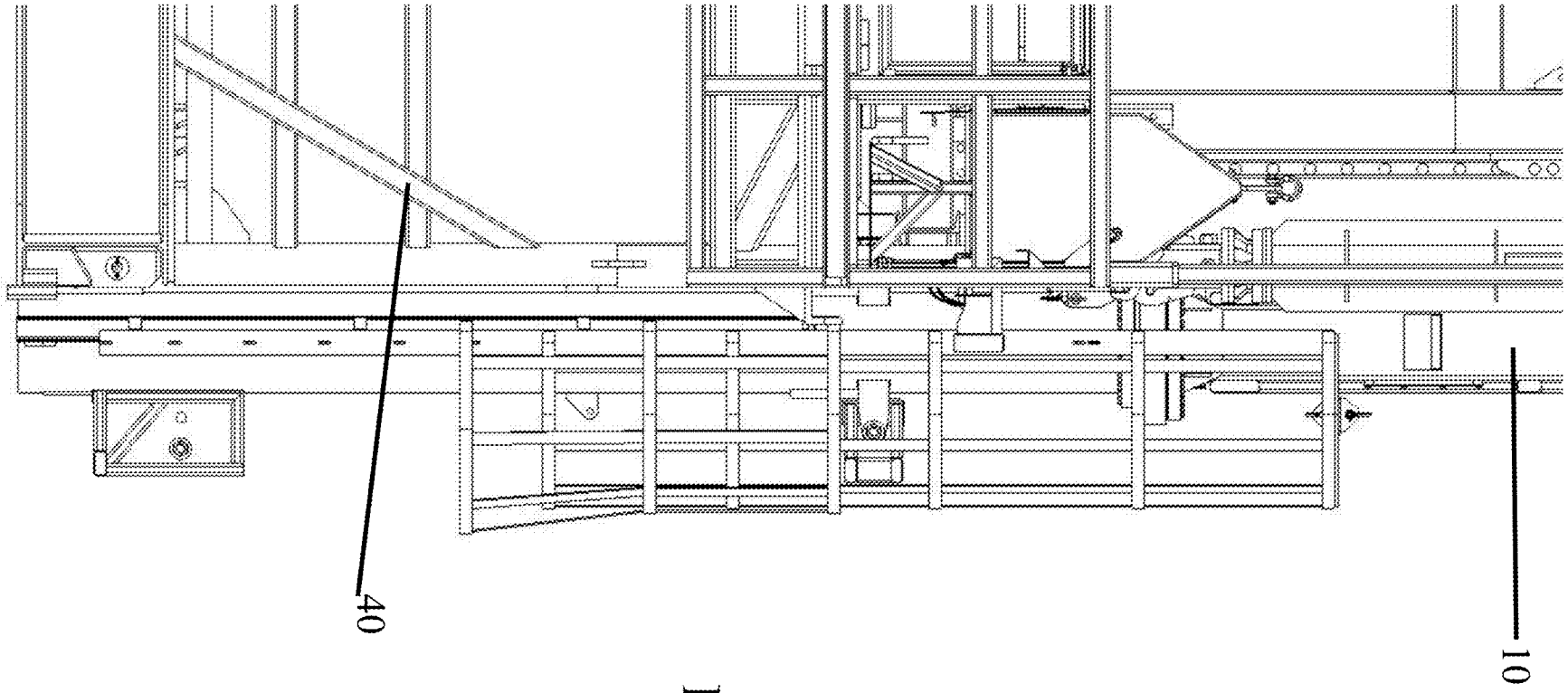
FIG. 41 is a close-up partial view of FIG. 40 showing the first embodiment of the apparatus of the present invention attached to a workbasket.
Figure 42:
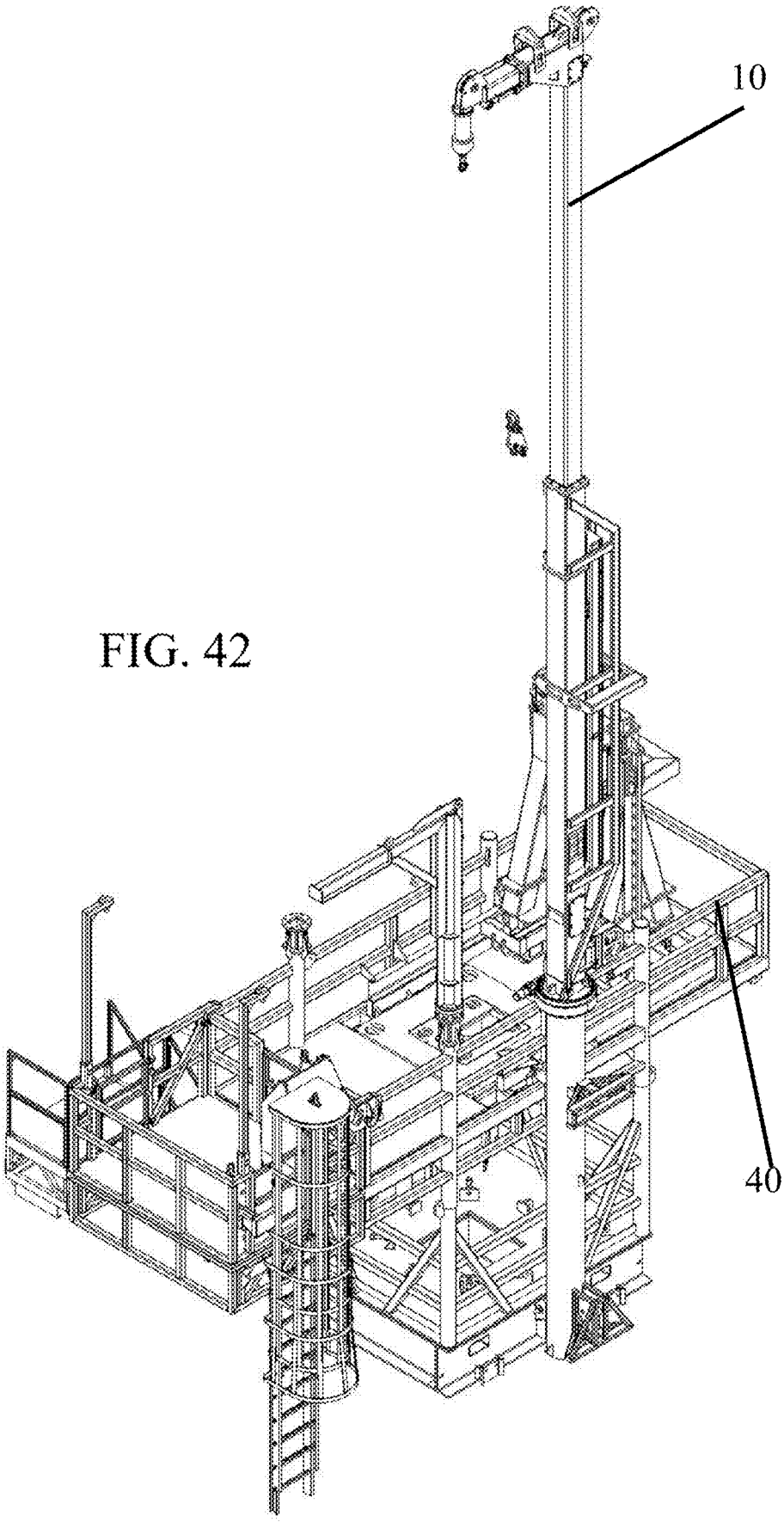
FIG. 42 is a perspective view of a first embodiment of the apparatus of the present invention attached to a workbasket.
Figure 43:
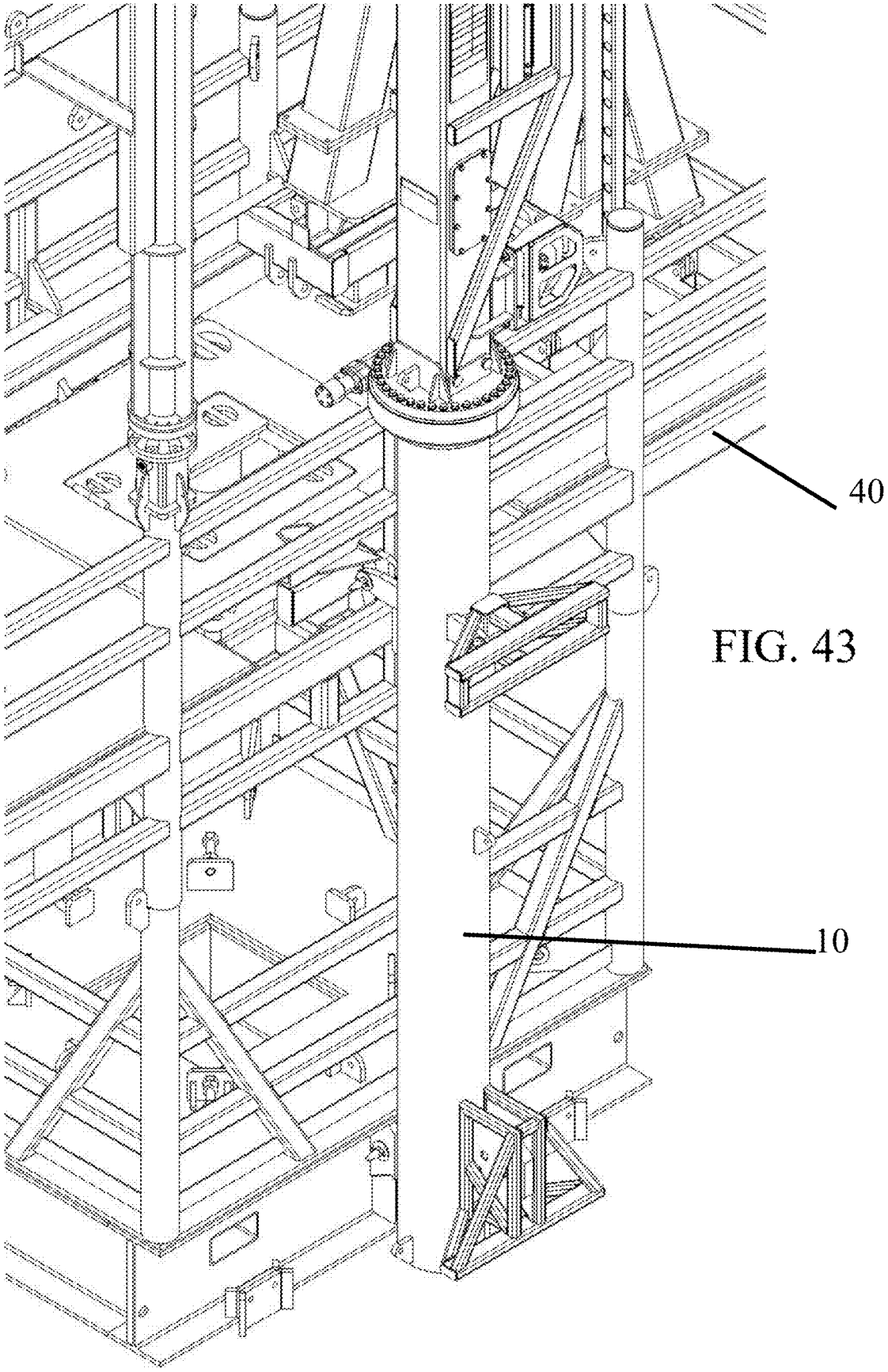
Figure 44:
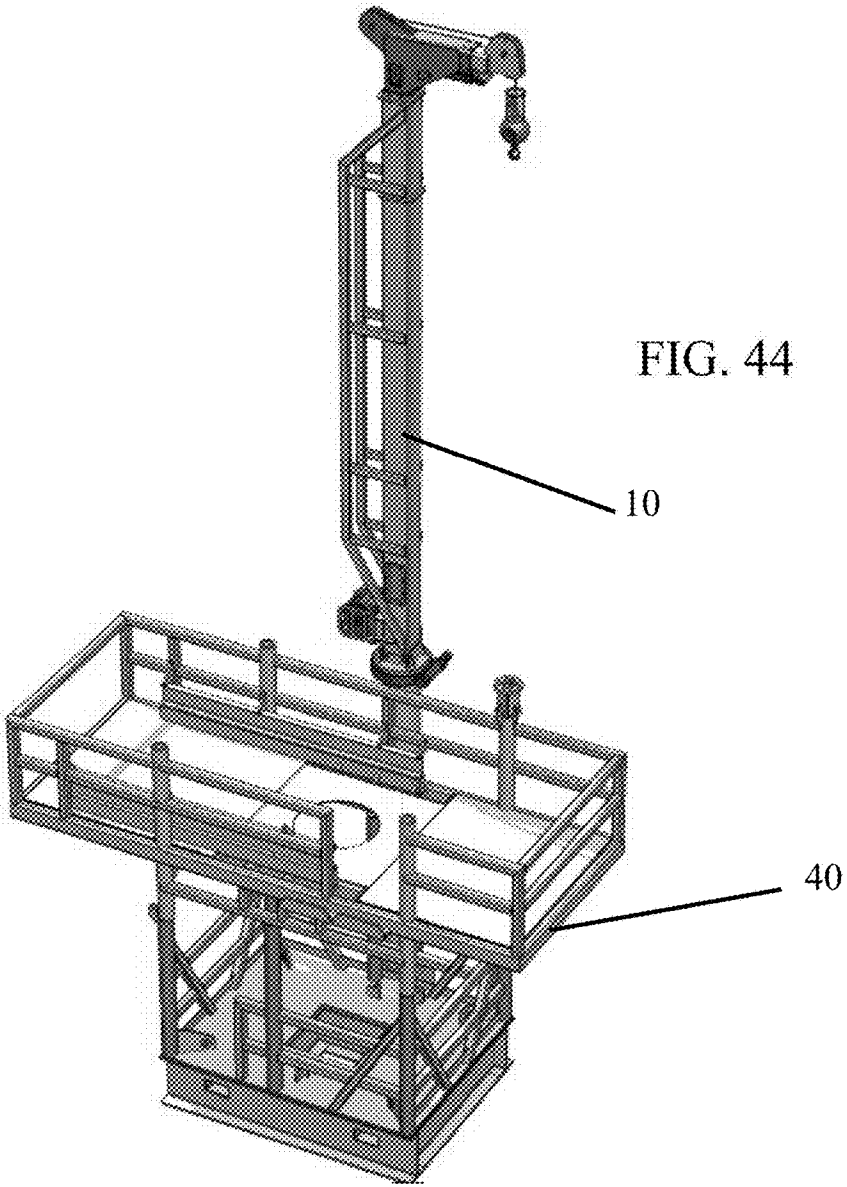

FIG. 1 shows a preferred embodiment of the apparatus of the present invention. The "Component Summary" table below describes the components which are labeled in FIG. 1. Those components labeled in FIG. 1 are parts that can be used in the present invention and are parts that are used in a first embodiment of the present invention. The present invention is not intended to be limited by the specific measurements set forth in the Component Summary, as utilizing parts of different dimensions will alter the specific capabilities of the present invention. A first preferred embodiment, shown in FIG. 1, can pull anywhere between twenty- and thirty-one-foot sections of surface/production casing and full joints of drill pipe and tubing. However, the present invention is not limited to pulling sections of the aforementioned lengths. The precise capabilities will be determined by the size and dimensions of the present invention. In a first preferred embodiment, the gin pole has approximately a seventeen-foot stroke.

Component Summary

| Part Number | Part | Description |
|---|---|---|
| 8 | Lift Eye-Gin Pole/Base Support Installation | Used to lift gin pole assembly for installation onto basket. Gin pole will hang at a slight angle. |
| 9 | Lift Eye-Gin Pole Vertical Lift | Used to lift gin pole assembly. Gin pole will hang nearly vertical |
| 11 | Wire Rope | |
| 12 | Boom Extension Assembly | Allows gin pole to reach between 49" to 61" from rotation center |
| 13 | Overhaul Ball | Keeps a minimum line tension when no-load is present |
| 14 | Hook | |
| 15 | Removable Access Cover-Top Pin Connection | Allows access to insert and remove top pin from mast extension cylinder |
| 20 | Removable Access Cover-Bottom Pin Connection | Allows access to insert and remove bottom pin from mast extension cylinder |
| 16 | Outer Mast Reinforcing Ring | Reinforces outer mast walls |
| 17 | Outer Mast | Main vertical support |
| 18 | Outer Mast Stiffening Bar | Aids in reducing overall deflection |
| 19 | Outer Mast to Stiffening Bar Connectors | Connects outer mast to stiffening bars |
| 30 | Sheave Assembly | Allows wire rope to change direction along a single plane |
| 29 | Inner Mast Telescoping Assembly | Allows gin pole to operate at a max hook height clearance between 20.5 ft to 37.5 ft |
| 28 | Hoist Assembly & Guard Frame | Hydraulically operated hoist with protective guard |
| 22 | Slew Drive | Transfers all Axial and Moment loads between Upper Gin Pole Assembly to Base Support while allowing 360° of rotation |
| 21 | Slew Drive Hydraulic Motor | Converts hydraulic energy to mechanical energy which is utilized for gin pole rotation |
| 23 | Upper Basket Connection-Drill Beam Base Setup | Allows for connection to Upper Basket while utilizing the Drill Beam Base Setup. |

-continued

| Part Number | Part | Description |
|---|---|---|
| 27 | Upper Basket Connection-BOP Baseplate Setup | Allows for connection to Upper Basket while utilizing the BOP Baseplate Setup. |
| 24 | Gin Pole Base Support | Main gin pole support when connecting to Jack Package |
| 25 | Drill Beam Base Connection | Allows for connection to the Drill Beam Base. |
| 26 | BOP Baseplate Connection | Allows for connection to the BOP Baseplate. |
| 10 | Gin pole | |
| 40 | Work basket | |

The foregoing embodiments are presented by way of example only; the scope of the present invention is to be limited only by the issued claim(s) of any patent(s) which may issue. One of ordinary skill in the art would understand where modifications or substitutions would be permitted without departing from the scope of the present invention.

The invention claimed is:

1. A gin pole comprising:
- a telescoping assembly;
- a bearing;
- a travelling boom;
- a drill beam base connection;
- a BOP baseplate connection; and
- a first upper basket connection and a second upper basket connection;
- wherein the first upper basket connection allows for connection to an upper basket while utilizing a drill beam base setup and the second upper basket connection allows for connection to an upper basket while utilizing a BOP baseplate setup;
- wherein the telescoping assembly functions without locking pins,
- the bearing allows for a full 180 degree rotation of the gin pole and a working radius of at least 48", and
- the travelling boom has a 12" extension range.

2. The gin pole of claim 1 wherein the gin pole does not utilize guy-wires.

3. The gin pole of claim 1 wherein the gin pole further comprises a support base, said support base configured to work on BOP bases, drill beam bases, and work platforms.

4. An apparatus to pick up and lay down joints of drill pipe, tubing and casing on plug and abandonment operations, comprising:
- an outer mast, wherein the outer mast includes stiffening bars and stiffening bar connectors;
- an inner mast, wherein the inner mast includes a telescoping assembly;
- a hydraulic cylinder;
- a boom extension assembly;
- a slew drive, wherein the slew drive includes a hydraulic motor;
- a drill beam base connection;
- a BOP baseplate connection; and
- a first upper basket connection and a second upper basket connection;
- wherein the first upper basket connection allows for connection to an upper basket while utilizing a drill beam base setup and the second upper basket connection allows for connection to an upper basket while utilizing a BOP baseplate setup; and
- wherein the slew drive allows three hundred sixty degree rotation of the gin pole.

5. The gin pole of claim 2 wherein the gin pole further comprises a support base, said support base configured to work on BOP bases, drill beam bases, and work platforms.

6. The gin pole of claim 1, wherein the travelling boom extends in a horizontal direction and the telescoping assembly extends in a vertical direction.

7. The gin pole of claim 1, wherein the telescoping assembly can extend approximately seventeen feet.

8. The apparatus of claim 4, wherein the telescoping assembly can extend approximately seventeen feet.

* * * * *